US006430851B1

(12) United States Patent
Clendenning

(10) Patent No.: US 6,430,851 B1
(45) Date of Patent: Aug. 13, 2002

(54) HAMMERLESS ATTACHMENT ASSEMBLY FOR A TWO-PART DIGGING TOOTH SYSTEM

(75) Inventor: Charles Clendenning, Broken Arrow, OK (US)

(73) Assignee: H&L Tooth Co., Tulsa, OK (US)

( * ) Notice: Subject to any disclaimer, the term of this patent is extended or adjusted under 35 U.S.C. 154(b) by 0 days.

(21) Appl. No.: 09/829,722

(22) Filed: Apr. 10, 2001

(51) Int. Cl.[7] ..... E02F 9/28

(52) U.S. Cl. ..... 37/457

(58) Field of Search ..... 37/452, 455, 456, 37/457, 453, 446; 172/701.1, 701.3

(56) References Cited

U.S. PATENT DOCUMENTS

| | | | |
|---|---|---|---|
| 5,337,495 A | 8/1994 | Pippins | 37/453 |
| 6,047,487 A | 4/2000 | Clendenning | 37/452 |
| 6,052,927 A | 4/2000 | Pippins | 37/454 |

*Primary Examiner*—Robert E. Pezzuto
(74) *Attorney, Agent, or Firm*—John W. Harbst

(57) ABSTRACT

A hammerless attachment assembly for releasably maintaining an adapter and replaceable part or tool of a two-part digging system in operable combination relative to each other. The hammerless attachment assembly includes an insert nonrotatably fitted within a recess defined on a side of the adapter nose portion and a rotatable fastener having a head portion and an externally threaded shank portion. A lengthwise portion of the extends through an opening having a closed margin defined in a side of the tool, with the opening in the side of the tool registering with the internally threaded bore in the insert when the tool is positioned on the adapter nose portion. The externally threaded shank portion of the fastener forms a threaded juncture with the internally threaded bore on the insert such that, in response to rotation of the fastener in a first direction, the insert is drawn toward and, ultimately, tightly clamped against an interior side surface of said blind cavity while remaining, at least partially, within the recess in the adapter thereby releasably maintaining the tool and adapter in operable combination relative to each other. Elastomeric material is disposed in operable combination with the rotatable fastener and the insert for inhibiting contaminants from adversely effecting the threaded juncture between the fastener and the insert thereby facilitating rotation of the fastener in a direction to effect release of the attachment assembly so as to allow repair/replacement of the replacement part of the two-part digging system.

26 Claims, 9 Drawing Sheets

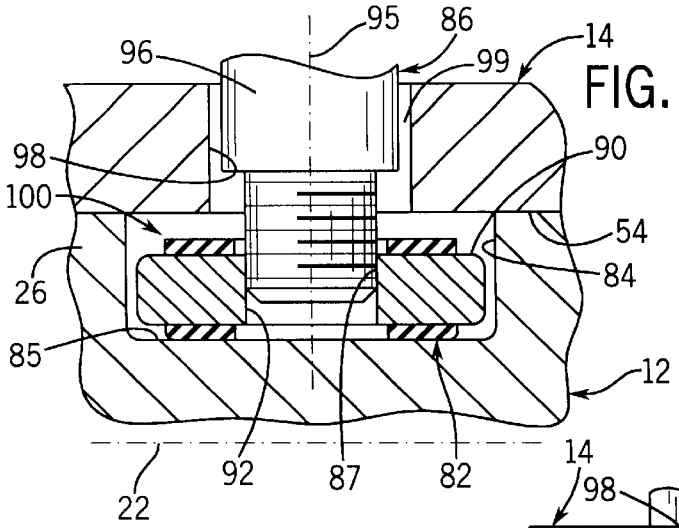
FIG. 14
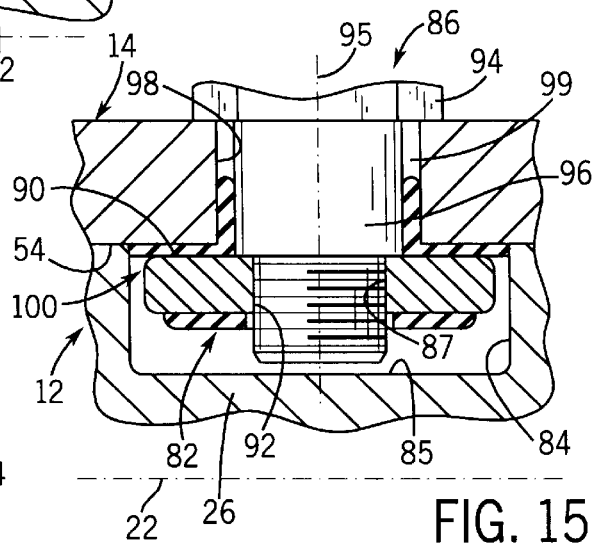
FIG. 15
FIG. 16
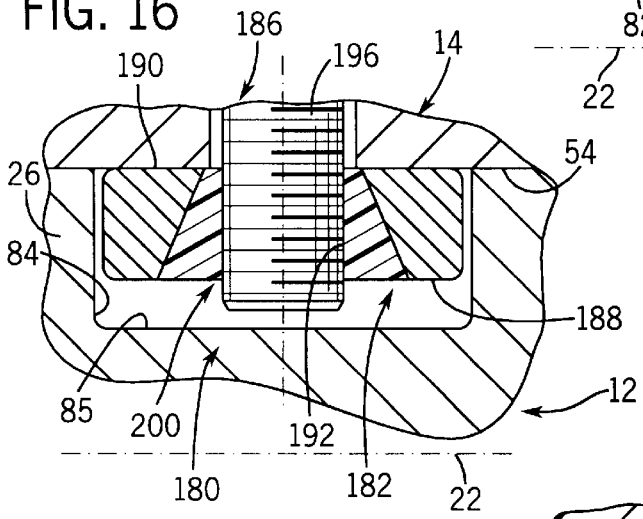
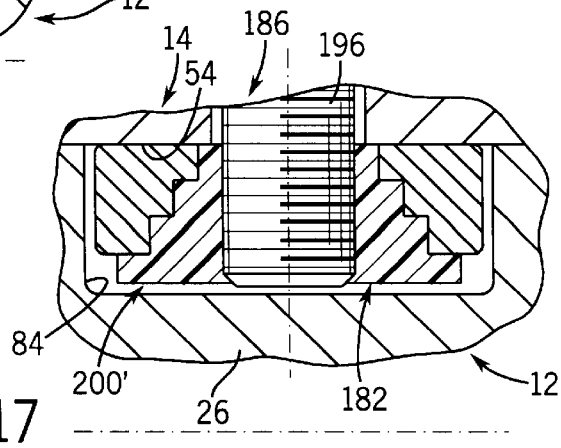
FIG. 17

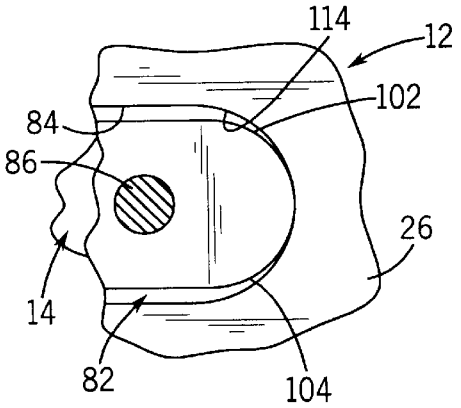
FIG. 25
FIG. 26
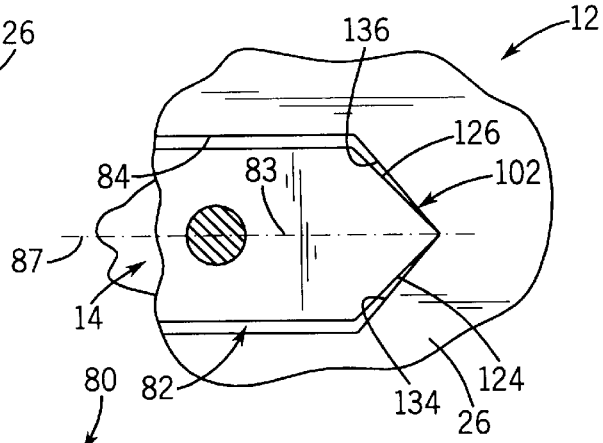
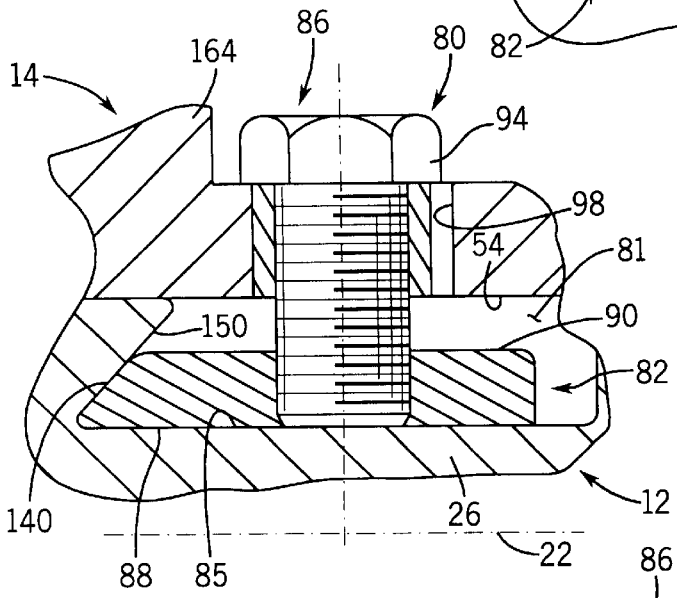
FIG. 27
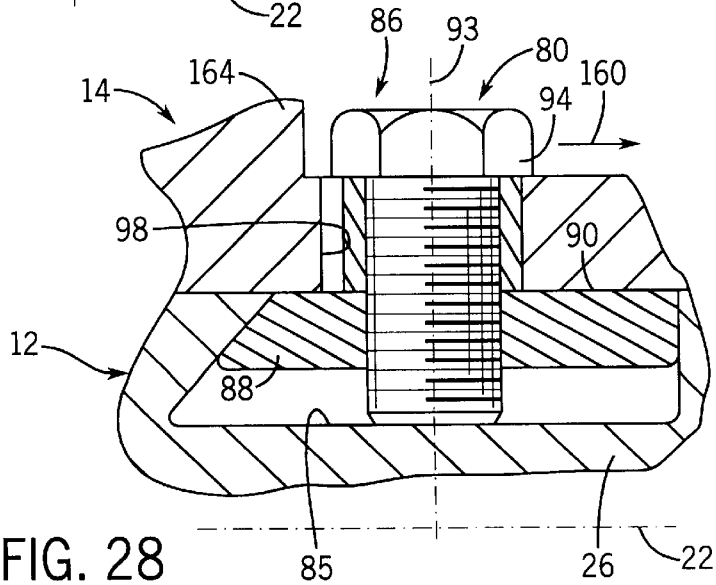
FIG. 28

HAMMERLESS ATTACHMENT ASSEMBLY FOR A TWO-PART DIGGING TOOTH SYSTEM

FIELD OF THE INVENTION

The present invention generally relates to a two-part digging tooth system and, more specifically, to a hammerless attachment assembly for releasably maintaining an adapter and a replacement part of a two-part tooth system in operable combination relative to each other.

BACKGROUND OF THE INVENTION

Excavating equipment used in mining, construction and a myriad of other ground engaging operations typically includes a series of spaced apart ground engaging tools or teeth arranged in side-by-side relation across a bucket lip or blade. The digging teeth project forwardly and serve to break up material to be gathered into a bucket of such excavating equipment.

The art recognized long ago the advantages to be gained by constructing each digging tooth as a two-part system. That is, the art recognized the advantages to be obtained by connecting a ground engaging tooth or tool to an adapter or support which, in turn, is connected to the bucket of excavating equipment. Typically, the adapter or support is provided with a base portion which is configured for attachment to the forward lip or blade of a bucket and a free ended nose portion. The digging tool is typically provided with a blind cavity or pocket whereby allowing the tool to fit over and along the adapter nose portion. As will be appreciated by those skilled in the art, the size of the adapter and digging tooth vary depending upon the particular digging application. For example, a two-part digging tooth system can vary in weight between a few pounds, i.e., three to five pounds, to two-hundred pounds.

During some digging operations, such teeth assemblies are subjected to highly abrasive conditions and, thus, experience considerable and rapid wear. Unless the conjuncture between the component parts of the two-part system is properly fitted, wear problems, especially in the pocket or cavity of the replacement part and along the nose portion of the adapter, can result. Moreover, the relatively high forces developed during some digging operations furthermore add to the rapid wear of the component parts of the digging tooth assembly.

In service, and although specific steps may be taken during fabrication of the digging teeth, a forward cutting edge of the replacement part sometimes quickly wears and become dull and, thus, inefficiencies in the digging operation develop thereby requiring replacement of such parts. As mentioned, the multipiece or two-part construction of such a tooth assembly advantageously allows the digging or excavating tooth to be replaced independent of the adapter. Depending upon conditions, a given adapter can be successfully equipped with anywhere from five to thirty replacement digging teeth to maintain sharp penetrating edges. In the field, replacement of worn excavating or digging teeth is a common and sometimes a daily experience.

It is well known in the industry to releasably interconnect the component parts of the two-component parts with an elongated retaining pin. Removing the replacement part from the digging system component parts, however, involves a tedious and often difficult task of pounding the retaining pin from registering apertures in the replacement part and the adapter. Removal of the retaining pin is typically effected by using a large hammer to manually and endwise force the retaining pin from the apertures in the digging tooth and adapter. Of course, with larger two-part digging systems, the retaining pins are proportionately sized larger thereby adding to the manual effort and, thus, increasing the time and effort involved to effect digging tooth replacement and/or repair. Problems involving the hammer missing the punch or other tool used to removably pound the retaining pin and hitting the hand of the operator are well known. Of course, similar problems exist when the retaining pin is again pounded into the apertures to effect reattachment of the replaceable part and the adapter. The availability of appropriate tools, i.e., hammers and punches, is a consistent and well known problem.

Many two part digging systems arrange the retaining pin along a generally horizontal axis. As will be appreciated by those skilled in the art, with the digging systems being mounted in side-by-side relation relative to each other across the bucket lip, the horizontal disposition of the retainer pin for each digging system only adds to the time and effort required to initially remove the pin, whereby allowing for removal/repair of the worn/broken part of the digging system and, subsequently, reinsertion of the pin into the registered apertures in the replacement part and adapter of the two-part system. Some operators utilize specially designed tools to facilitate removal of the horizontal pins. Of course, availability of such tools is another problem.

It is also known to arrange the retaining pin in a generally vertical orientation. While advantageously enhancing access to the retaining pin, such retaining devices are more susceptible to the forces applied thereto as a result of the generally vertical movements of the bucket during a digging/excavating operation. Moreover, with a vertically oriented pin system, the lower hole or aperture in the replacement part of the two-part digging system is more exposed—as compared to a horizontal pinning system—to the ground surface over which the digging implement or bucket moves during a digging operation.

In any digging or excavating operation, contaminants including rocks, dust, dirt fines, moisture, and etc. furthermore exacerbate removal of the retaining pin. During any digging or excavating operation, small rocks, stones, dirt, dirt fines, and dust quickly accumulate, fill, and pack into holes or apertures in the digging tooth and adapter. As will be appreciated, moisture readily and quickly moves between confronting surfaces formed at the conjuncture of the digging tooth and adapter and passes toward the retaining pin. As is well known, the moisture corrodes and rusts on the surfaces of both the retainer pin and closed margins of the apertures in the digging tooth and adapter thereby adding to the problem of retaining pin removal. Moreover, such moisture often combines with the small rocks, stones, dirt, dirt fines, and dust already packed and filled into the apertures or holes of the component parts of the two-part tooth system, thereby adding to the considerable labor already involved with effecting tooth replacement.

Using threaded devices for releasably interconnecting component parts of a two-part tooth system have been previously proposed. For example, U.S. Pat. Nos. 5,337,495 and 6,052,927 to S. Pippins disclose an externally threaded tooth point bolt in combination with an insert for releasably maintaining a digging tooth and adapter in operable combination relative to each other. Like others before, the Pippins devices do not solve the problem of having contaminants including small rocks, stones, dirt, dirt fines, dust, and moisture passing into the apertures and onto both internal and external threads of the interconnecting devices thereby resulting in clogging, oxidation and corrosion of the mating surfaces. Of course, contamination of any mating threaded surfaces as by clogging, oxidation or rusting can only further add to the problems of disconnecting the related parts relative to each other when servicing of the worn part of the two-part system, is required. Moreover, the Pippins devices fail to disclose any means for inhibiting wear between the component parts of a two-part digging tooth system.

Thus, there is a desire and a continuing need for a hammerless attachment assembly for releasably maintaining component parts of a two-part digging tooth system in operable combination relative to each other. There is also a continuing need and desire for a two-part tooth system having an attachment assembly which enhances the conjuncture between the component parts of the system thereby reducing wear between the parts.

SUMMARY OF THE INVENTION

In view of the above, and in accordance with one aspect of the present invention, there is provided a hammerless attachment assembly for releasably maintaining component parts of a two-part digging tooth system in operable combination relative to each other. The component parts of the tooth system include an adapter having a nose portion with multiple sides and a ground engaging tool defining an open ended blind cavity or pocket for allowing the tool to fit over and along a length of the adapter nose portion.

The hammerless attachment assembly of the present invention includes an insert nonrotatably fitted within a recess defined on a side of the nose portion of the adapter and a rotatable fastener having a head portion and an externally threaded shank portion. A lengthwise portion of the fastener extends through an opening having a closed margin defined in a side of the tool, with the opening in the side of said tool registering with the internally threaded bore in said insert when the tool is positioned on the nose portion of the adapter. To releasably fasten the tool and adapter in operable combination relative to each other, the externally threaded shank portion of the fastener forms a threaded juncture with the internally threaded bore on the insert such that, in response to rotation of the fastener in a first direction, the insert is drawn toward and, ultimately, moved into clamping relation with an interior side surface of said blind cavity while remaining, at least partially, within the recess in the adapter thereby releasably maintaining the tool and adapter in operable combination relative to each other.

According to one aspect of the invention, elastomeric material is disposed in operable combination with the rotatable fastener and the insert for inhibiting contaminants from adversely effecting the threaded juncture between the fastener and the insert. As will be appreciated by those skilled in the art, inhibiting contaminants from adversely effecting the threaded juncture between the fastener and the insert will facilitate rotation of the fastener in a direction opposed to said first direction when the tool is to be released from operable combination with the adapter.

In one form, the elastomeric material extends along the entire lengthwise section of the externally threaded shank portion of the fastener extending through the insert. In another form, elastomeric material is configured as part of the insert and defines the internally threaded bore for the insert. In this form, the elastomeric material has an exterior configuration which inhibits separation of the elastomeric material from the insert as the insert is drawn toward and ultimately moved into clamping relation with the interior side surface of said blind cavity defined by the tool.

The insert preferably includes inner and outer surfaces. The insert's inner surface faces the adapter and the outer surface of the insert is arranged adjacent the interior side surface of the blind cavity after the fastener is rotated to draw the insert into clamping relationship therewith. Alternatively, the insert can embody a two-piece construction with a first piece or part defining the internally threaded bore and the second part or piece being arranged in operable engagement with the first part when the insert is inserted into the recess in the side surface of the adapter. According to still another aspect of the invention, the insert is formed from a non-ferrous material. Accordingly, moisture passing between the parts of the digging system will have limited, if any, adverse effect on the threaded juncture established between the insert and the threaded fastener.

In yet another embodiment, and in response to the insert being clamped against the interior surface of the tooth cavity, elastomeric material is squeezed between insert and the interior surface of the tooth cavity. In this form, elastomeric material furthermore extends, at least partially, into operable surrounding relation with the externally threaded shank portion of said fastener thereby inhibiting contaminants from getting through to the threaded juncture between the fastener and the insert. As such, the threaded juncture is sealed against contaminants interfering with proper and efficient operation between the fastener and insert of the retainer assembly.

As will be appreciated by those skilled in the art, the nose portion of the adapter and the blind cavity or pocket defined by the tool have complimentary cross-sections. In a preferred form, at least a top surface of the nose portion of the adapter is configured with two angled sides disposed on opposed lateral sides of a longitudinal centerline of the adapter. Similarly, the blind cavity defined by the tool opens to a rear end of the tool and includes a top surface having two angled sides disposed on opposed lateral sides of the longitudinal centerline of the tool and are complimentary relative to the angle sides on the top surface of the adapter.

The angled configuration of the sides on the nose portion of the adapter and tool cavity provide advantages over other cross-sectional configurations at the conjuncture between the tool and adapter. For example, the angled sides on the adapter and cavity advantageously provide a larger bearing surface at the conjuncture between the adapter and tool than is offered by horizontally configured surfaces. Of course, a larger bearing surface yields enhanced load distribution of the forces imparted to those surfaces. Moreover, the angled side configuration on the adapter and cavity advantageously provide a self-centering effect at the conjuncture between the tool and the adapter.

In this regard, both the insert accommodating recess in the side of the adapter and the insert are preferably configured to enhance the self-centering effect between the tool and the adapter on which it is mounted. More specifically, the recess defined in the side of the adapter and the insert are preferably configured with complimentary surfaces which cooperate relative to each other to enhance the self-centering effect at the conjuncture between the tool and adapter. Moreover, when the top surface of the adapter is configured with angled sides, the open top insert accommodating recess in the side of the adapter defines an axis extending generally normal to the side surface of the adapter to which the recess opens.

Another aspect of the present invention relates to the ability of the attachment assembly to enhance the conjuncture between the adapter and tool by urging to the tool onto the nose portion of the adapter in response to the fastener being rotated in a direction to tighten the clamping relationship of the insert against the interior surface of the blind cavity defined by the tool. To effect such ends, the rotatable fastener of the attachment assembly includes a portion for engaging a closed margin of the opening in the side of the replacement part through which the fastener extends. Moreover, the insert and the insert accommodating recess on the nose portion of the adapter define confronting surfaces which cooperate relative to each other as the insert is drawn toward the interior surface of the cavity, in response to rotation of the fastener. The confronting surfaces cause the insert and, ultimately, the replacement part to move rearward in a direction extending generally parallel to the longitudinal axis of the adapter thereby enhancing the tightness of the conjuncture between the interior surfaces of the blind cavity and the nose portion of the adapter.

A primary object of the present invention is to provide an improved attachment assembly for releasably maintaining a replacement part and an adapter of a two-part digging system in operable combination relative to each other.

A further object of the present invention is to provide a hammerless attachment assembly for a two-part digging system including a replacement part and an adapter and which offers enhanced ease of repair/replacement of the replacement part, when required, during a digging operation.

Another object of the present invention involves providing a hammerless attachment assembly for a two-part digging system including a replacement part and an adapter and wherein the two-parts of the digging system are maintained in operable combination relative to each other through a fastener forming a threaded juncture with an insert arranged in a recess on the adapter and wherein elastomeric material inhibits contaminants, inherent with digging environments, from adversely effecting the threaded juncture thereby promoting release of the fastener from the insert, when required, and, thus, enhancing replacement of worn parts of the two-part digging system.

Still another object of the present invention is to provide a hammerless attachment assembly for releasably maintaining a replacement part and an adapter of a two-part digging system in operable combination relative to each other and wherein the attachment assembly includes a rotatable fastener which enhances the conjuncture between the replacement part and the adapter in response to rotation of the fastener in a direction to releasably fasten the replacement part to the adapter.

These and other numerous objects, aims, and advantages of the present invention will become readily apparent from the following detailed description, drawings, and appended claims.

DETAILED DESCRIPTION OF THE DRAWINGS

FIG. 14 is an enlarged view taken along line 14—14 of FIG. 1;

FIG. 15 is a view similar to FIG. 14 but showing the insert arranged in clamping relation relative to an interior surface of a blind cavity defined by the tool or replaceable part of the two-part digging system;

FIG. 16 is an enlarged, partially sectioned, view similar to FIGS. 14 and 15 but showing another alternative form of insert forming part of the attachment assembly of the present invention;

FIG. 17 is an enlarged view of still another alternative form of insert forming part of the attachment assembly of the present invention;

FIG. 25 is an enlarged plan view of another configuration for one end of the insert and the recess in the adapter which accommodates the insert;

FIG. 26 is an enlarged plan view of another configuration for one end of the insert and the recess in the adapter which accommodates the insert;

Figure 1:
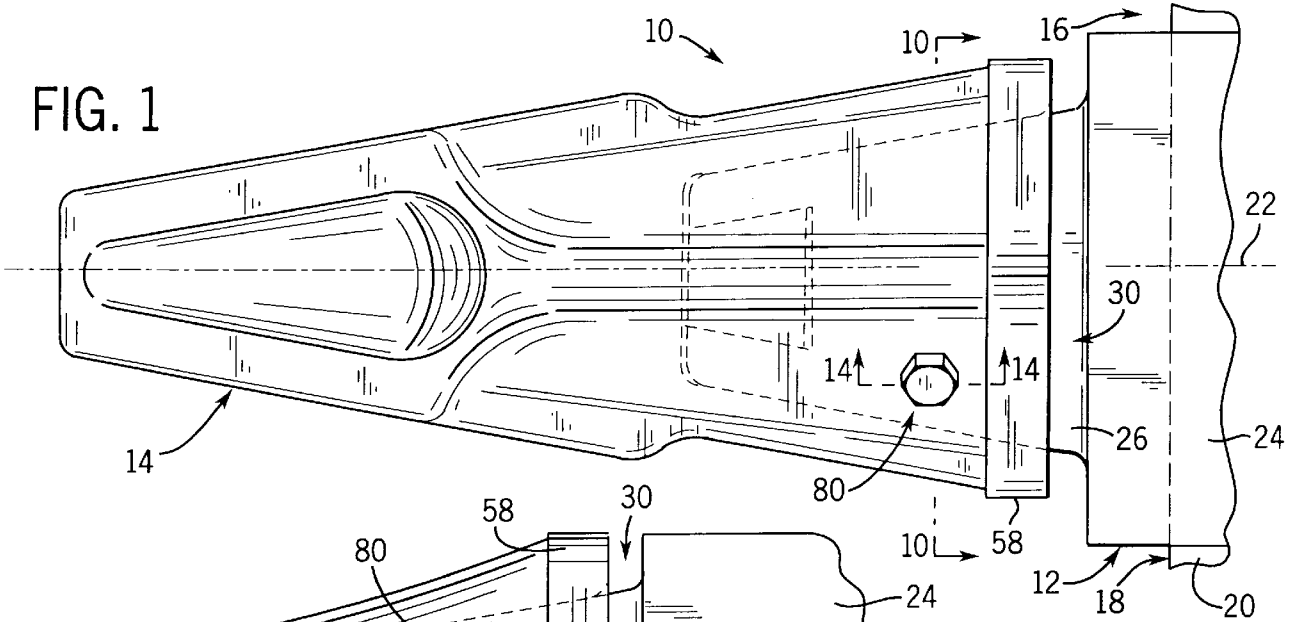
FIG. 1 is a top plan view of one form of two-part digging system embodying features of the present invention.
Figure 2:
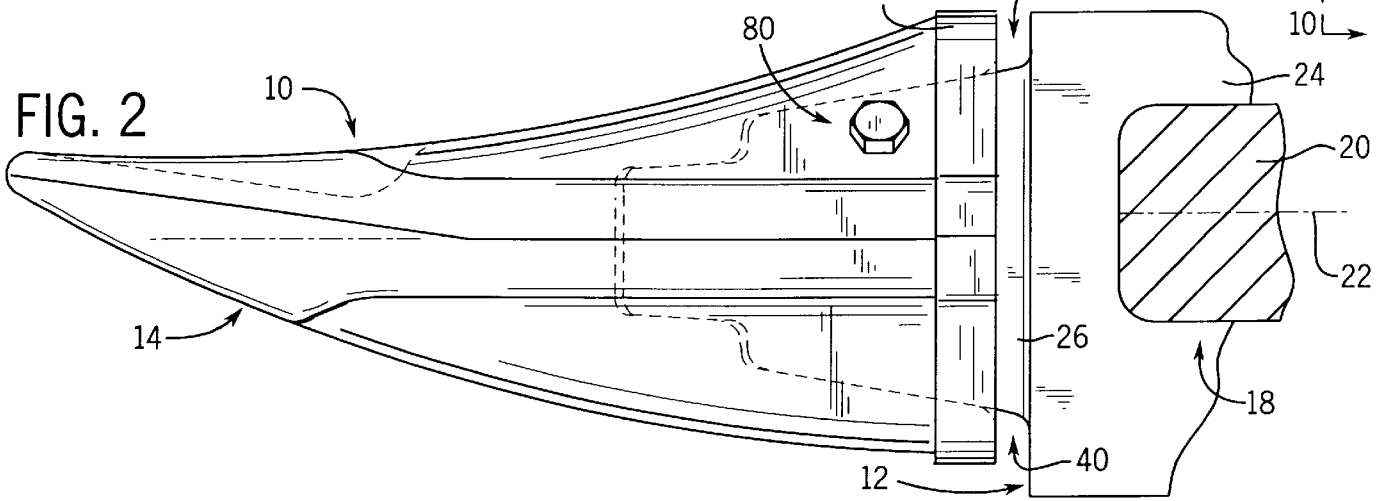
FIG. 2 is a side elevational view of the two-part digging system shown in FIG. 1.
Figure 3:
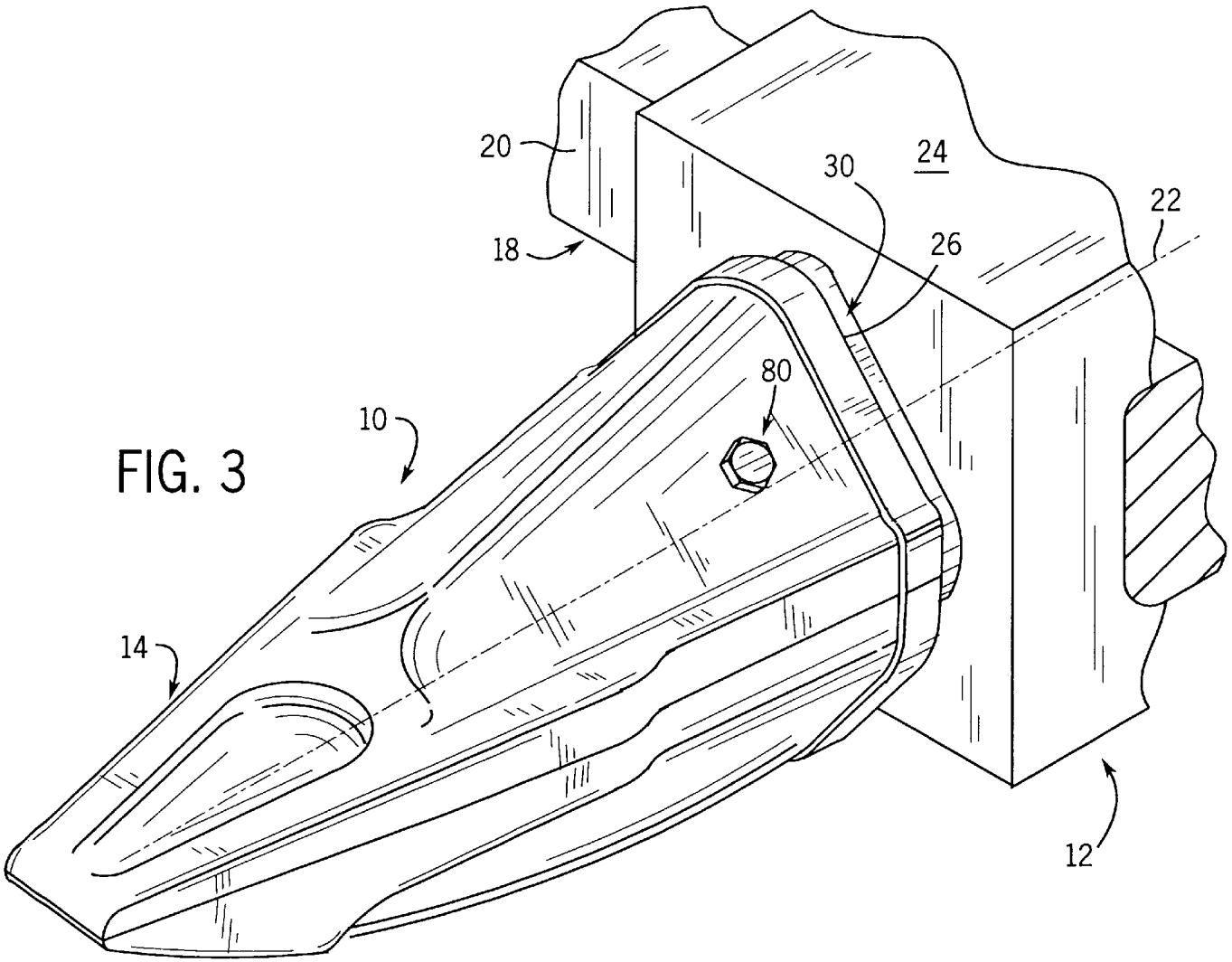
FIG. 3 is a perspective view of the two-part digging system illustrated in FIG. 1.

FIG. 27 is enlarged, partially sectioned, view showing cooperating surfaces on the insert and the adapter for advantageously enhancing the conjuncture between the adapter and replacement part of the two-part digging system in response to the attachment assembly of the present invention being utilized to maintain the adapter and tool or replacement part of the two-part digging system in operable combination relative to each other; and FIG. 28 is a view similar to FIG. 27 but showing the insert of the attachment assembly in clamping relation relative to an interior surface of a blind cavity defined by the replacement part or tool of the two-part digging system.

Detailed Description of the Present Invention

While the present invention is susceptible of embodiment in multiple forms, there are shown in the drawings and will hereinafter be described various preferred embodiments of the present invention with the understanding the present disclosure is to be considered as setting forth exemplifications of the invention which are not intended to limit the invention to the specific embodiments illustrated and described.

Referring now to the drawings, wherein like reference numerals indicate like parts throughout the several views, there is shown in FIG. 1 a two-part digging system 10 including a support 12 and a replaceable part 14. In the illustrated embodiment, the replaceable part 14 of the digging system 10 is shown as a digging tooth. It should be appreciated, however, the replaceable part 14 can take a myriad of different designs other than a tooth, i.e., a ripper, etc.

Although only a single ground engaging tooth assembly 10 is shown in FIG. 1 attached to excavating equipment 16, such as a forward lip 18 of an excavating bucket or the like 20, it will be understood to those skilled in the art that on a typical piece of excavating or digging equipment, a plurality of two-part digging systems, substantially identical to that illustrated in FIG. 1, extend forwardly from the bucket lip or blade 18 in a ground engaging orientation. Moreover, it should be appreciated that the bucket or shovel 20 to which the two-part system 10 is attached moves both vertically and horizontally during a digging operation.

As schematically illustrated in FIGS. 1 through 4, the adapter or support 12 has an elongated free ended configuration defining a longitudinal centerline 22. The adapter or support 12 includes a conventional base portion 24 and axially aligned and elongated nose portion 26 extending forwardly from the base portion 24. The base portion 24 is configured for suitable attachment to the ground engaging apparatus or bucket 20. As is conventional, the replaceable part or tooth 14 fits endwise along and about the nose portion 26 of the adapter 12. In a preferred embodiment, the adapter 12 is formed as a result of a forging operation thereby adding strength and rigidity to the adapter 12.

Although a specifically configured nose portion 26 for the adapter 12 is illustrated in the drawings and will hereinafter be described, it should be appreciated the principals of the present invention equally apply to adapters which are configured other than that illustrated in the drawings and hereinafter described. In the preferred form, the nose portion 26 of the adapter 12 has a forwardly tapering configuration including angularly converging top and bottom exterior surfaces 30 and 40, respectively. In the illustrated embodiment, the top and bottom surfaces 30 and 40, respectively, are disposed to opposed vertical sides of the longitudinal centerline 22 of the adapter 12. In a most preferred embodiment, the top and bottom exterior surfaces 30, 40, respectively, are each provided with stabilizing lands 32 and 42 preferably arranged at the foremost end of the adapter 12.

In the embodiment illustrated for exemplary purposes, the conjuncture between the adapter 12 and replaceable part 14 has been configured to provide and effect advantageous results during operation of the two-part digging system 10. More specifically, the adapter 12 and replaceable part 14 are configured to enhance the surface area contact at the conjuncture between the adapter 12 and replaceable part 14. Moreover, the conjuncture between the adapter 12 and replaceable tool 14 is preferably configured to promote a self-centering effect of the replaceable part 14 on and along the nose portion 26 of the adapter 12.

Figure 6:
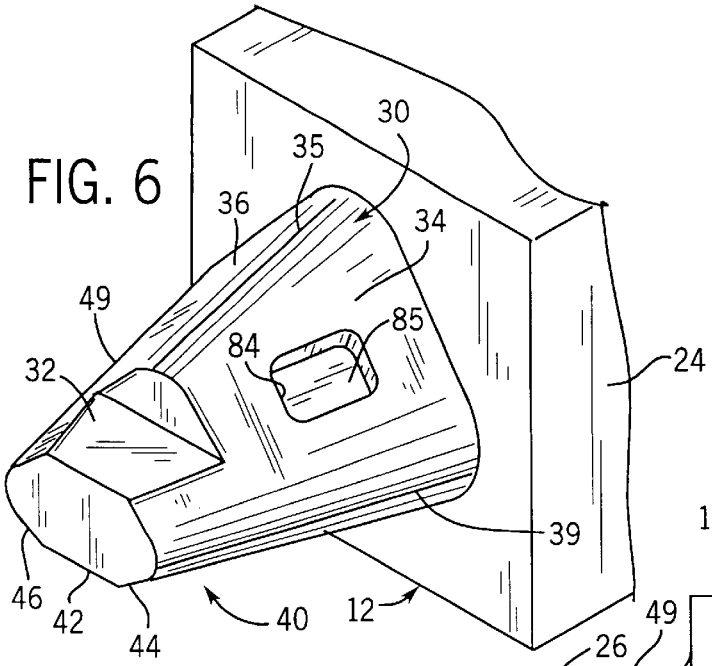
FIG. 6 is a perspective view of the adapter illustrated in FIG. 4.
Figure 4:
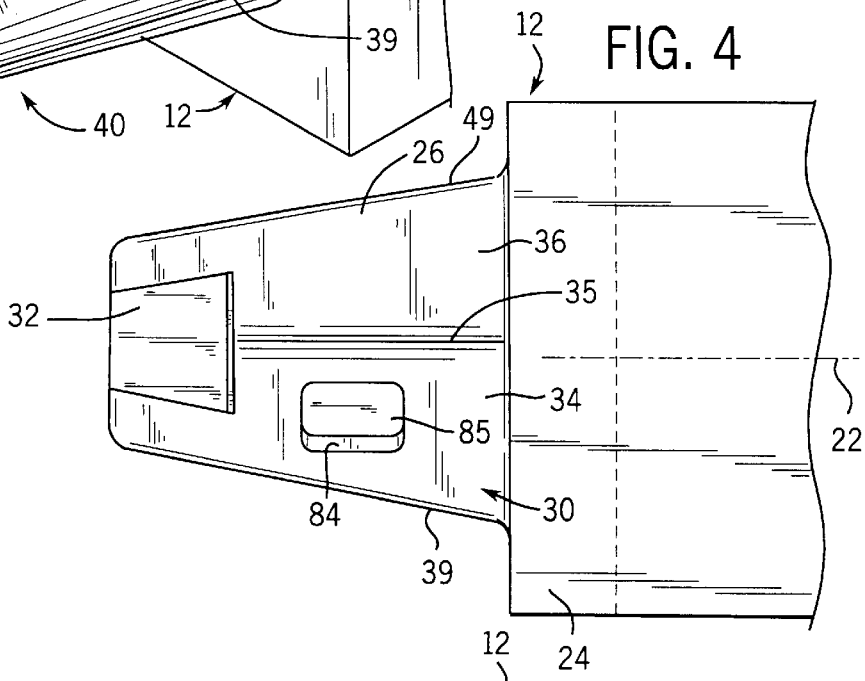
FIG. 4 is a top plan view of one form of adapter to which principals of the present invention would apply.
Figure 5:
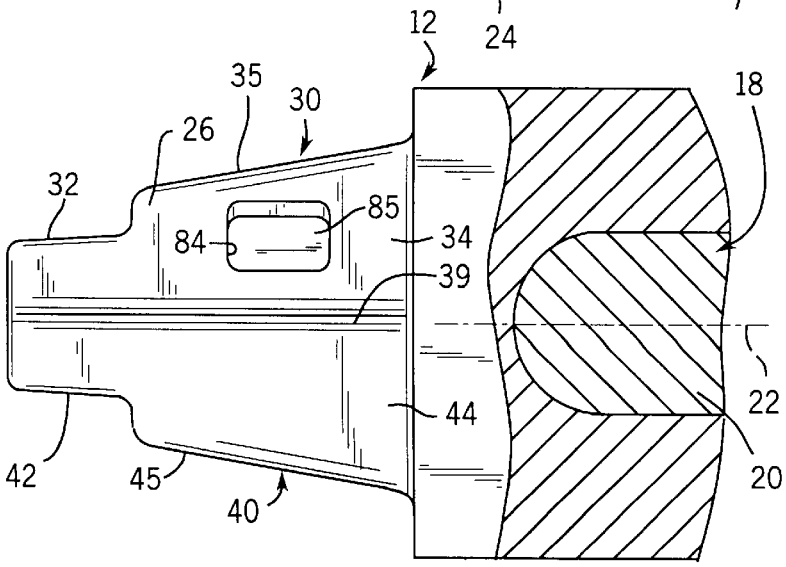
FIG. 5 is a side elevational view of the adapter illustrated in FIG. 4.

As shown in FIGS. 4 and 6, the exterior top surface 30 of the adapter nose portion 26 is preferably provided with two angled sides 34 and 36 arranged on opposite lateral sides of the longitudinal centerline 22 of the adapter 12. Each side 34, 36 of top surface 30 preferably has a generally planar configuration extending downwardly at an angle ranging between about 30° and about 70° relative to a horizontal plane. In a preferred embodiment, each side 34, 36 of the top surface 30 angles downwardly at an angle of about 50° relative to a horizontal plane. Moreover, the angled sides 34, 36 are preferably joined to each other along a common top edge 35 extending forwardly from a rear portion and for a major length of the adapter 12. In a most preferred form, the common top edge 35 has a radiused configuration.

In the illustrated embodiment, the exterior bottom surface 40 of the adapter 12 is provided with two angled sides 44 and 46 arranged on opposite lateral sides of the longitudinal centerline 22 of the adapter 12. The sides 44, 46 are preferably planar in configuration. When considered with the angled sides 34, 36 of the exterior top surface 30, the upwardly angled sides 44, 46 of the bottom surface 40 preferably provide a major lengthwise section of the nose portion 26 of the adapter 12 with a rhombus-like or quadrilateral configuration. The angled sides 44, 46 of the exterior bottom surface 40 of the adapter 12 are preferably joined to each other along a common bottom edge 45 extending forwardly and for a major lengthwise portion of the adapter 12. In a most preferred form, the common bottom edge 45 has a radiused configuration.

In the embodiment of the invention illustrated for exemplary purposes, the angled sides 34, 44 disposed to a common lateral side of the longitudinal axis of the adapter 12 are preferably joined to each other along a common side edge 39 extending longitudinally forward from the base portion 24 for a major length of the nose portion 26 of the adapter 12. The common side edge 39 is formed at the intersection of those planes defined by and along the planar configuration of the sides 34, 44. Preferably, the common side edge 39 has a radiused configuration.

Similarly, the angled sides 36, 46 disposed to a common lateral side of the longitudinal axis 22 of the adapter 12 are preferably joined to each other along a common side edge 49 extending longitudinally forward from the base portion 24 and for a major length of the nose portion 26 of the adapter 12. The common side edge 49 is formed at the intersection of those planes defined by and along the planar configuration of the sides 36, 46. Preferably, the side edge 49 has a radiused configuration.

Figure 7:
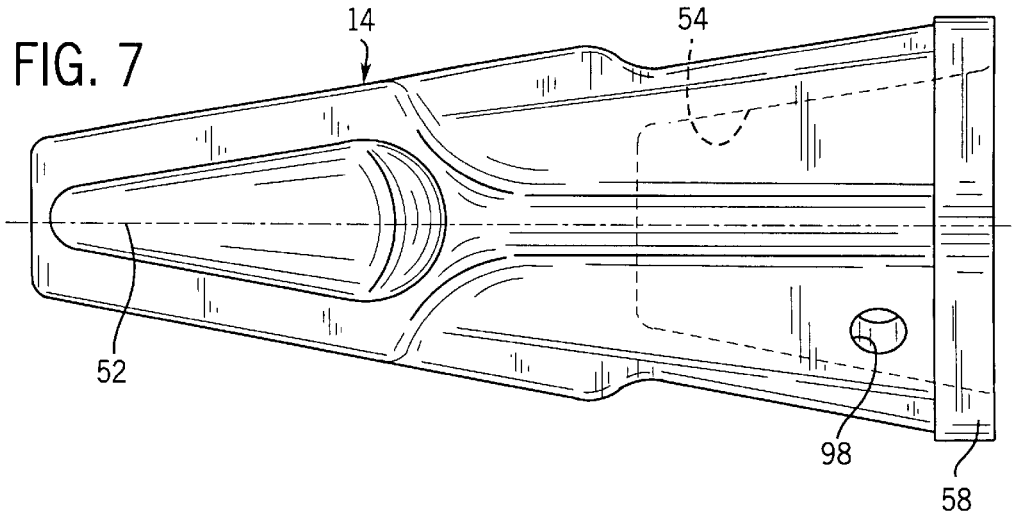
FIG. 7 is a top plan view of one form of replacement part or tool forming part of the two-part digging system to which principals of the present invention apply.
Figure 8:
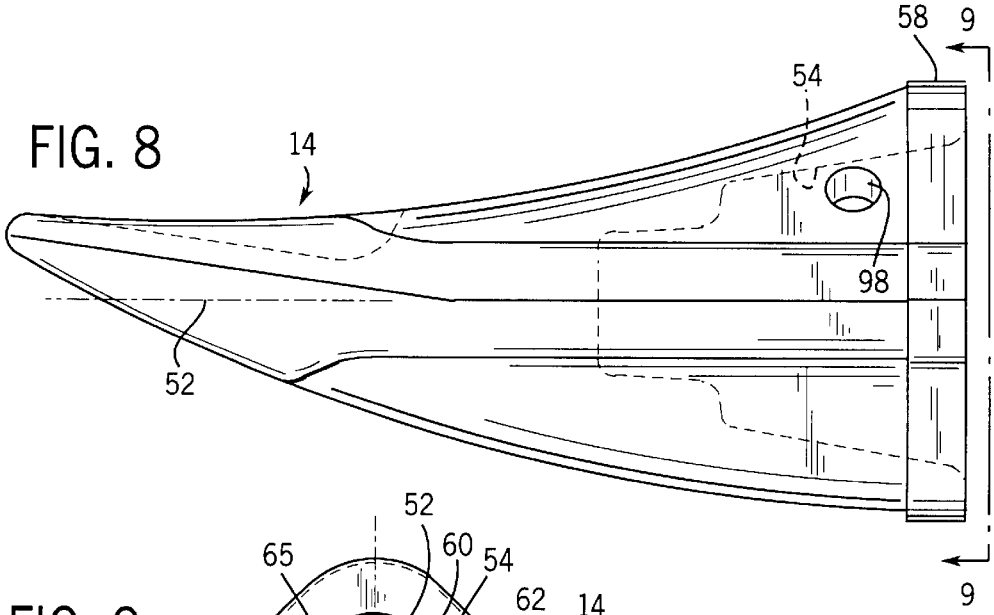
FIG. 8 is a side elevational view of the replacement part illustrated in FIG. 7.
Figure 9:
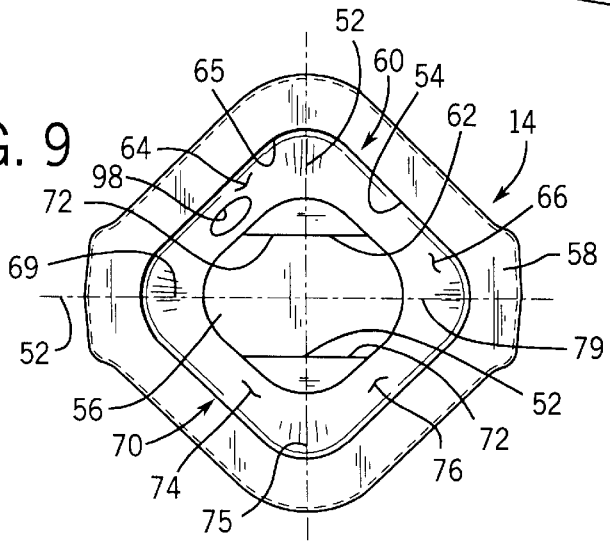
FIG. 9 is a rear end view of the replacement part illustrated in FIG. 7.

The replacement part or digging tooth 14 of the two-part digging system 10 generally has an elongated wedge shape with a longitudinal centerline 52 and is configured to fit lengthwise along and about the nose portion 26 of the adapter 12 (FIG. 4). To effect such ends, and as illustrated in FIGS. 7 through 9, a rear portion of the replacement part or tool 14 is configured with multiple sides which combine to define an open ended blind cavity 54 therebetween. Suffice it to say, the multiple exterior sides of the replacement part can take on a myriad of different shapes as long as the cross-sectional configuration of the cavity or pocket 54 closely proximates the cross-sectional configuration of the nose portion 26 of the adapter 12 and whereby the conjuncture between the adapter 12 and the replacement part or tool 14 minimizes movement between component parts of the two-part digging system 10 after the component parts 12, 14 are arranged in operable combination relative to each other. To add strength and rigidity thereto, part 14 is preferably formed from a forging operation.

The open ended blind cavity or pocket 54 includes top and bottom interior surfaces 60 and 70, respectively, extending forwardly from the open rear end of the cavity 54. As will be appreciated, the top and bottom interior surfaces 60, 70 angularly converge toward each other at substantially the same angles as the top and bottom exterior surfaces 30, 40, respectively, of the adapter nose portion 24. The top and bottom interior surfaces 60, 70, respectively, terminate in an end wall 56 defined by cavity 54.

As shown, the top and bottom interior surfaces 60 and 70, respectively, of cavity 54 are disposed to opposed vertical sides of the longitudinal centerline 52 of part 14. In a most preferred embodiment, the top and bottom surfaces 60 and 70, respectively, each include stabilizing lands 62 and 72, respectively, extending rearwardly from the end wall 56. Preferably, the stabilizing lands 62, 72 on part 14 cooperate and mate with the stabilizing lands 32, 42 on the adapter 12 after the component parts 12, 14 are arranged in operable combination relative to each other to facilitate transfer of forces applied to the assembly 10 to the excavating equipment 16.

The blind cavity or pocket 54 defined by part 14 preferably has a rhombus-like or quadrilateral cross-sectional configuration. In the preferred embodiment, the interior top surface 60 includes two angled sides 64 and 66 arranged on opposite lateral sides of the longitudinal centerline 52 of part 14. Preferably, each side 64, 66 of cavity 54 has a generally planar configuration extending downwardly at an angle generally corresponding to the angle of the confronting surface 34, 36 on the exterior top surface 30 of the adapter nose portion 26. Moreover, the sides 64, 66 of top surface 60 are preferably joined to each other along a common top edge 65 extending forwardly from the open end 58 and for a major length of the cavity 54. In a most preferred form, the common top edge 65 has a radiused configuration.

In the embodiment illustrated, the interior bottom surface 70 of cavity 54 is provided with two upwardly angled sides 74 and 76 arranged on opposite lateral sides of the longitudinal centerline 52 of part 14. The sides 74, 76 are preferably planar in configuration and are preferably joined to each other along a common bottom edge 75 extending forwardly from the open end and for a major length of the cavity 54. In a most preferred form, the common bottom edge 75 has a radiused configuration.

Preferably, the angled sides 64, 74 of the cavity 54 which are disposed to a common lateral side of the longitudinal axis 52 of part 14 are joined to each other along a common side edge 69 extending longitudinally forward from the open end and for a major length of the cavity 54. The common side edge 69 is formed at the intersection of those planes defined by and along the planar configuration of the sides 64, 74. The common side edge 69 preferably has a radiused configuration.

Similarly, the angled sides 66, 76 of the cavity 54 disposed to a common lateral side of the longitudinal axis 52 of part 14 are preferably joined to each other along a common side edge 79 extending longitudinally forward from the open end and for a major length of the cavity 54. The common side edge 79 is formed at the intersection of those planes defined by and along the planar configuration of the sides 66, 76. Preferably, the side edge 79 has a radiused configuration.

Figure 10:
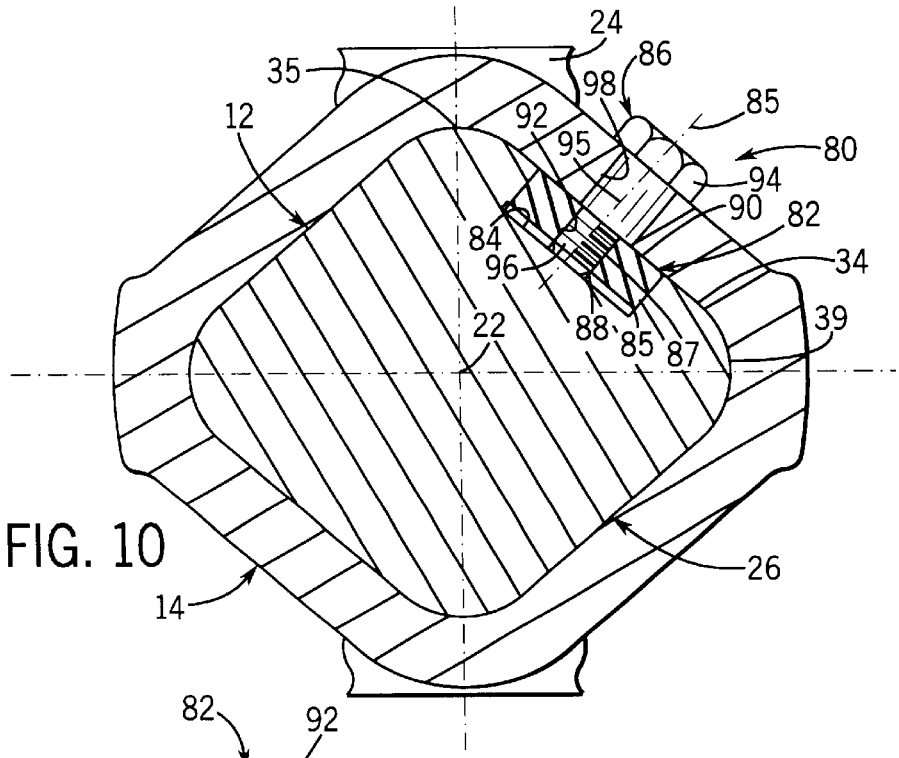
FIG. 10 is a sectional view taken along line 10—10 of FIG. 1.

In accordance with the present invention, a hammerless attachment assembly 80 maintains the adapter 12 and replaceable part or tool 14 in operable combination relative to each other. As schematically illustrated in FIG. 10, the hammerless attachment assembly 80 includes an insert or first part 82 nonrotatably fitted or accommodated within a recess or cavity 84 defined by the adapter 12 and a rotatable threaded fastener or second part 86. The first and second parts 82 and 86, respectively, combine with each other, through an operative or threaded juncture 87, to selectively maintain the component parts 12 and 14 in operable combination relative to each other.

Broadly stated, one of the salient features of the present invention involves providing elastomeric material in operable combination with the insert or first part 82 and the threaded fastener or second part 86 of the attachment assembly 80 whereby inhibiting contaminants from getting through to or adversely effecting the operative or threaded juncture between the component parts 82, 86 of the attachment assembly 80 after the adapter 12 and replacement part or tool 14 of the two-part digging system 10 are arranged in operable combination relative to each other. As used herein and throughout, the term "elastomeric material" means and refers to: natural rubber, synthetic rubber, plastic, polyvinyl, polymide materials, nylon, composites, polyethylene, ultra-high molecular weight materials, and any of numerous organic, synthetic, or processed materials or substances which are strong and, to a limited degree, compressible. Preferably, such elastomeric materials have a Shore A hardness ranging between about 50 and about 80.

As schematically illustrated in FIGS. 4 through 6 and 10, recess 84 has an open top configuration and is preferably defined toward the rear on side 36 of the exterior top surface 30 of adapter 12. In the example illustrated in FIG. 10, the recess 84 is preferably disposed about middistance between the common top edge 35 and the common side edge 39 defined by the adapter nose portion 26. In the example illustrated in FIG. 10, recess 84 defines an axis 85 extending generally normal or perpendicular to the planar side 34 of the adapter nose portion 26.

As will be appreciated from an understanding of the present invention, the recess or cavity 84 is configured to removably receive, accommodate and prevent the insert 82 from rotating or turning in a plane parallel to the side 34 of the adapter 12 after the threaded fastener or second part 86 threadably engages with the insert 82 to removably secure the parts 12 and 14 of assembly 10 in operable combination relative to each other. In the illustrated embodiment, recess 84 has a generally rectangular configuration. It should be understood, however, various shapes can be used for the recess 84, such as square, triangular, star-shaped and the like, so long as insert 82 has a complimentary shape and such that rotation of the insert 82 in a plane parallel to the exterior side of the adapter 12 defining the recess 84 is prevented after the insert 82 is inserted thereinto.

Of course, and as will be furthermore appreciated, the recess 84 could readily be located on side 34 of the top surface 30 of the nose portion 26 of adapter 12 without detracting or departing from the spirit and scope of the present invention. Albeit preferable with the illustrated embodiment of the two-part digging system to locate the recess 84 on either side 34, 36 of the top surface 30 of the adapter 12, it is, of course, possible to alternatively locate the recess 84 on either side 44, 46 of the bottom surface 40 of the nose portion 26 of the adapter 12 without departing or detracting from the spirit and scope of the present invention.

Figure 11:
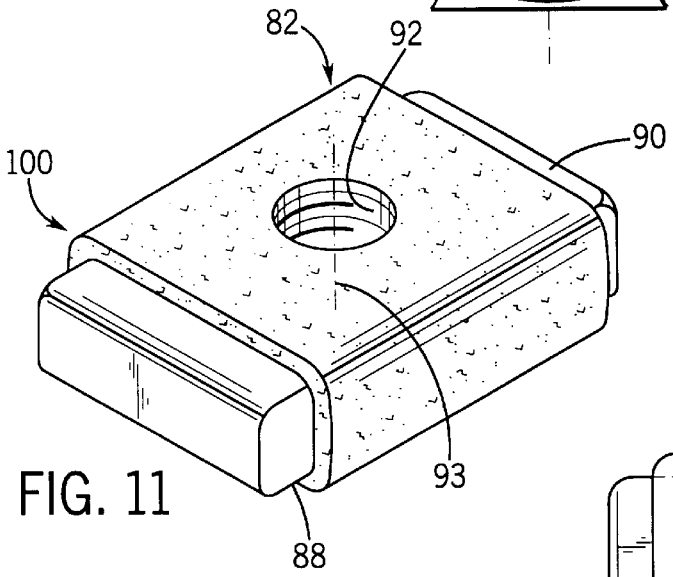
FIG. 11 is a perspective view of one form of insert forming part of the attachment assembly of the present invention.
Figure 12:
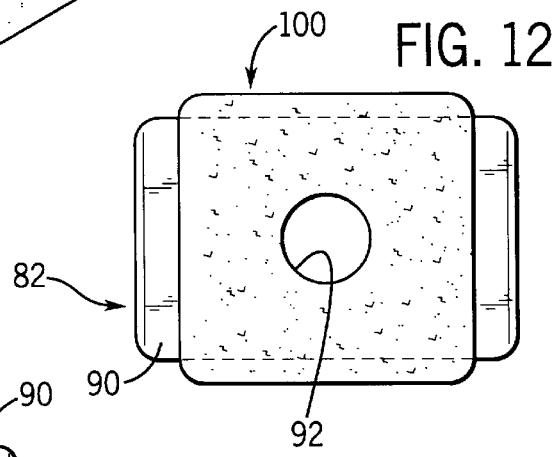
FIG. 12 is a top plan view of the insert illustrated in FIG. 11.
Figure 13:
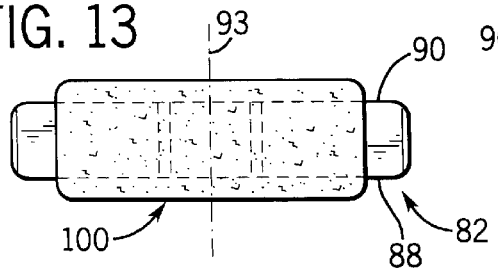
FIG. 13 is a side elevational view of the insert illustrated in FIG. 11.

As illustrated in FIGS. 10, 11 and 13, insert 82 has inner and outer surfaces 88 and 90, respectively. The inner surface 88 of insert 82 is disposed adjacent to and in confronting relation with a bottom surface 85 of the recess or cavity 84 after the insert 82 is initially inserted within the recess 84. The outer surface 90 of insert 82 is disposed a further radial distance from the axis 22 of the adapter 22 than is inner surface 88. In the illustrated embodiment, the surfaces 88 and 90 of insert 82 are arranged in generally parallel relation relative to each other. An internally threaded bore or throughopening 92 is generally centrally defined by the insert 82. As shown, the bore or threaded opening 92 defines an axis 93 extending generally normal or perpendicular to at least one surface 88, 90 defined by the insert 82.

In the embodiment illustrated in FIG. 10, the second part or threaded fastener 86 includes first and second portion 94 and 96, respectively. The first and second portions 94 and 96 of the fastener 86 are preferably axially aligned relative to each other along an axis 95 of the fastener 86. The first portion 94 of fastener 86 is preferably configured as a head portion which is removably engagable by a conventional tool to effect rotation of the fastener 86 in either first or second directions about the axis 95. The second or shank portion 96 of fastener 86 has an externally threaded configuration and forms the threaded juncture 87 when the second or shank portion 96 of fastener 86 threadably engages with the internally threaded bore 92 of the first part or insert 82 of the hammerless attachment assembly 80.

As illustrated in FIGS. 10, 14 and 15, the second or threaded shank portion 96 of fastener 86 is sized to extend lengthwise through a preferably closed marginal bore, throughopening, or elongated slot 98 defined in that side of the digging tool or replaceable tooth 14 which is complimentary to that exterior side of the adapter nose portion 26 defining the recess 84. Notably, the bore, throughopening, or elongated slot 98 of the replaceable part 14 is sized such that the first or head portion 94 of the fastener 86 is inhibited from passing into the opening 98 even though and after the externally threaded shank portion 96 of fastener 86 and the internally threaded bore 92 on insert 82 establish and maintain a threaded juncture therebetween. As shown, and to facilitate assembly, the closed margin of the bore, throughopening, or elongated slot 98 has an inside diameter which is slightly larger than the outside diameter on the second or shank portion 96 of the fastener 86 whereby an opening or gap 99 is defined therebetween.

In that form illustrated in FIGS. 11 through 15, elastomeric material 100 is provided, at least, between the outer surface 90 of insert 82 and the confronting interior surface of the tooth cavity or pocket 54 toward and against which the insert 82 is drawn in response to rotation of the fastener 86 in the first direction. As will be appreciated, in response to rotation of the fastener 86 in a first direction, insert 82 is drawn toward and, ultimately, is moved into tightly clamped relation with the confronting interior surface of the tooth cavity or pocket 54 while remaining, at least partially, within the insert accommodating recess or cavity 84 thereby releasably maintaining the adapter 12 and replaceable tooth 14 in operable combination relative to each other.

As the insert 82 is drawn into clamping relationship with the confronting interior surface of the tooth cavity 54, elastomeric material 100 is squeezed and flows into the opening 99 around the fastener shank portion 96 and the closed margin of the tooth aperture, bore or opening 98 through which the fastener shank portion 96 extends. Likewise, the squeezed elastomeric material 100 tends to flow and fill tolerance variations or voids separating that area on the adapter angled side 34 immediately surrounding the recess 84 and the confronting interior surface of the tooth pocket or cavity 54. As such, contaminants including small rocks, stones, dirt, dirt fines, dust, and moisture are inhibited from passing between the conjoined surfaces of parts 12 and 14 and reaching the threaded juncture 87 between the insert 82 and the threaded fastener 86.

With the present invention, the elastomeric material 100 inhibits contaminants from adversely effecting the threaded juncture 87 between parts 82 and 86 of assembly 80. Accordingly, rotation of the fastener 86, in a direction opposed to the first direction, is facilitated when part 14 is to be released from the adapter 14. As will be appreciated by those skilled in the art, the ability to maintain the threaded juncture 87 substantially removed from contaminants significantly reduces the likelihood of clogging, oxidation or rusting of the mating surfaces between the externally threaded shank portion 96 of fastener 86 and the internally threaded bore 92 of the insert 82. Eliminating or reducing clogging, oxidation or rusting of the mating surfaces between the externally threaded shank portion 96 of fastener 86 and the internally threaded bore 92 of the insert 82 naturally tends to facilitate rotation of the fastener 86 in a direction to effect release of the hammerless attachment assembly 80 thereby readily allowing repair and/or replacement of part 14 of the two-part digging system 10.

FIG. 16 illustrates an alternative form for the insert of the hammerless attachment assembly of the present invention. This alternative form of insert is designated generally by reference numeral 182. The elements of this alternative hammerless attachment system that are functionally analogous to those components discussed above regarding attachment assembly 80 are designated by reference numerals identical to those listed above with the exception this embodiment uses reference numerals in the 100 series.

In the form illustrated in FIG. 16, elastomeric material 200 is configured as part of the insert 182 and defines the internally threaded bore 192 of the insert 182. Notably, the exterior configuration of the insert 200 is such that the elastomeric material 200 is prevented from separating from the remainder of the insert 182 as the insert 182 is drawn toward and, ultimately, moved into clamping relation relative with an interior surface of the pocket or cavity 54 of the replaceable tooth 14. In the illustrated embodiment, the exterior configuration of the elastomeric material 200 and the mating part of the insert 182 have mating frusto-conical configurations with the larger end thereof being disposed toward the inner surface 188 of the insert 182.

With this form of the invention, the elastomeric material 200 extends along at least the entire lengthwise section of the externally threaded shank portion 196 of the fastener 186 extending through the insert 182. As such, the elastomeric material 200 protects the entire lengthwise section of the externally threaded shank portion 196 of the fastener 186 extending through the insert 182 against clogging, oxidation or rusting of the mating surfaces between the externally threaded shank portion 196 of fastener 186 and the internally threaded bore 192 of the insert 182. Thus, this design naturally tends to facilitate rotation of the fastener 186 in a direction to effect release of the hammerless attachment assembly 180 thereby readily allowing repair and/or replacement of part 14 of the two-part digging system 10.

That embodiment of the invention illustrated in FIG. 17 is substantially similar to that illustrated in FIG. 16 but shows a slightly different exterior configuration for the elastomeric material 200'. Suffice it to say, in this form, the elastomer 200' is configured to prevent separation of the elastomer 200' from the remainder of the insert 182 when the fastener 186 is rotated in a direction to draw the insert 182 into tight clamping relation with the interior surface of the tool cavity 54. Like that discussed above, the elastomeric material 200' extends along at least the entire lengthwise section of the externally threaded shank portion 196 of the fastener 186 extending through the insert 182. As such, the elastomeric material 200' protects the entire lengthwise section of the externally threaded shank portion 196 of the fastener 186 extending through the insert 182 against clogging, oxidation or rusting of the mating surfaces between the externally threaded shank portion 196 of fastener 186 and the internally threaded bore 192 of the insert 182. Thus, this design naturally tends to facilitate rotation of the fastener 186 in a direction to effect release of the hammerless attachment assembly 180 thereby readily allowing repair and/or replacement of part 14 of the two-part digging system 10.

In yet another form, the insert for the hammerless attachment assembly of the present invention can be fabricated from a nonferrous metal material which is corrosion resistant such as copper, brass or any of several other nonferrous metal materials. Because the insert of the attachment assembly is corrosion resistant, rotation of the fastener in a direction to effect release of the attachment assembly, thus, enabling repair/replacement of the tool 14 will be facilitated. Because of the significant loads and forces expected to be exerted and which are placed onto the attachment assembly during operation of the two-part digging system 10, however, use of a nonferrous metal insert as part of the hammerless attachment assembly could have limited application to smaller size two-part digging systems.

Figure 18:
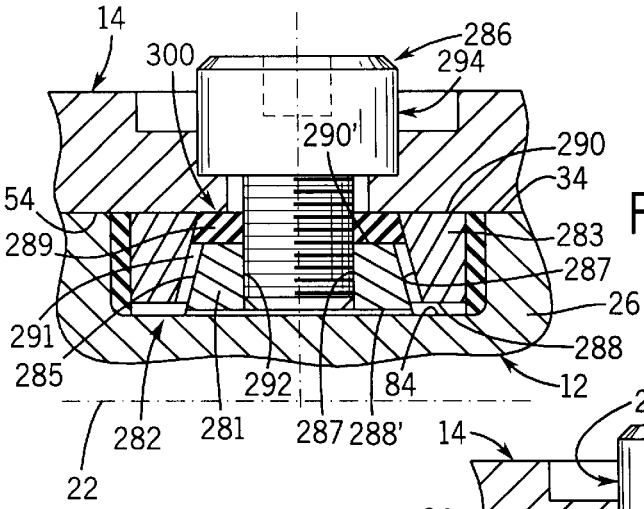
FIG. 18 is an enlarged view of yet another form of insert forming part of the attachment assembly of the present invention.
Figure 19:
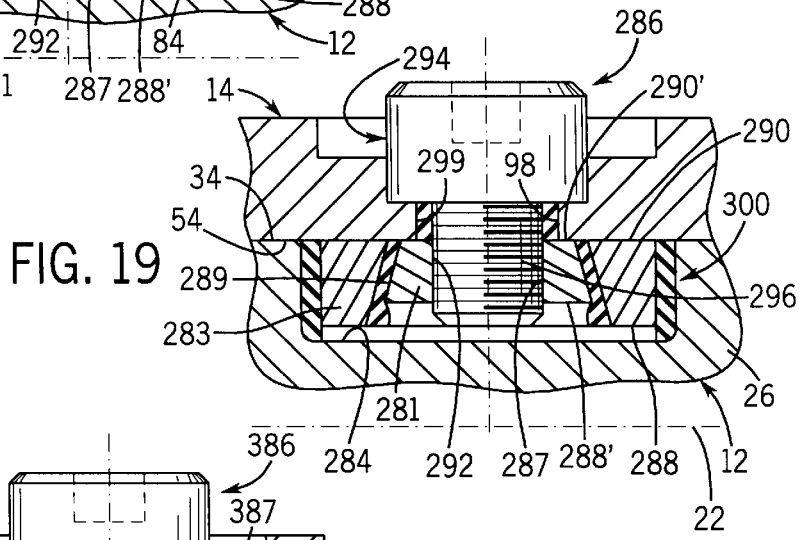
FIG. 19 is a view similar to FIG. 18 but showing the insert arranged in clamping relation relative to an interior surface of a blind cavity defined by the tool or replaceable part.

FIGS. 18 and 19 illustrate an alternative form for the insert of the hammerless attachment assembly of the present invention. This alternative form of insert is designated generally by reference numeral 282. The elements of this alternative hammerless attachment assembly that are functionally analogous to those components discussed above regarding attachment assembly 80 are designated by reference numerals identical to those listed above with the exception this embodiment uses reference numerals in the 200 series.

In the form illustrated in FIG. 18, the insert 282 comprises two metal pieces or parts 281 and 283. Piece 281 of insert 282 defines the internally threaded bore or opening 292 for the insert 282. The exterior configuration of insert 282 is sized to fit within the recess or cavity 84 on the side of the adapter 12. Moreover, piece 283 of insert 282 defines inner and outer surfaces 288 and 290, respectively, which, in the exemplary embodiment, extend generally parallel relative to each other. As shown, piece 281 also defines inner and outer surfaces 288' and 290', respectively. The inner and outer surfaces 288' and 290' of piece 281 are separated by a lesser distance than are corresponding surfaces on piece 283. Accordingly, when the pieces 281 and 283 of insert 282 are initially assembly within the recess 84, an opening or void 289 exists between parts 281 and 283.

As shown, the pieces 281 and 283 of insert 282 are configured such that piece 281 is prevented from separating from piece 283 as piece 281 is drawn toward the outer surface 290 of the insert 282 in response to rotation of the threaded fastener 286 to, ultimately, clamp the insert 282 against the interior surface of cavity 54 of the tool 14, as shown in FIG. 19, whereby releasably maintaining the adapter 12 and tool 14 in operable combination relative to each other. In the exemplary embodiment, pieces 281 and 283 of insert 282 define frusto-conical surfaces 285 and 287, respectively. The frusto-conical surfaces 285 and 287 of pieces 281 and 283, respectively, are sized relative to each other to define an opening or gap 291 therebetween.

In the embodiment illustrated in FIGS. 18 and 19, and upon initial assembly of insert 282, elastomeric material 300 is provided, at least, in the opening or gap 289 between the parts 281, 283 and the inner interior surface of the cavity or pocket 54 against which the insert 282 is to be, ultimately clamped. Preferably, additional elastomeric material 300 is arranged between the sides of the insert 282 and the cavity or recess 84 in the adapter 12.

As will be appreciated, in response to rotation of the fastener 286, piece 281 is drawn toward the interior surface of the tooth pocket or cavity 54. As piece 281 is drawn toward the interior surface of the tooth pocket or cavity 54, the elastomeric material 300 is squeezed and flows into the opening 291 between the parts 281, 283 and into the opening 299 around the second or shank portion 296 of fastener 286 and the closed margin of the aperture, bore or hole 98 in the replaceable tool 14 through which the second or shank portion 296 of the fastener 286 extends. Likewise, the squeezed elastomeric material 300 tends to flow and fill a tolerance variations or voids separating that area on the adapter angled side 34 immediately surrounding the recess 84 and the confronting interior surface of the tooth pocket or cavity 54. As such, contaminants including small rocks, stones, dirt, dirt fines, dust, and moisture are inhibited from passing between the confronting surfaces of parts 12 and 14 and reaching the threaded juncture 287 between parts 282 and 286. Ultimately, rotation of the fastener 286 causes the insert 282 to be drawn and tightly clamped against the interior surface of the tooth cavity or pocket 54 while at least a portion of the insert 282 remains within the recess or cavity 84 thereby maintaining the adapter 12 and tooth 14 in operable combination relative to each other.

In the embodiment illustrated in FIGS. 18 and 19, the bore 98 in part 14 is preferably configured as a counterbore. As such, a major portion or section of the first or head portion 294 of the fastener 286 is removed and protected from the exterior surface of the tool or replacement part thereby protecting the first or head portion 294 of the fastener 286 during operation of the two-part digging system 10.

Figure 20:
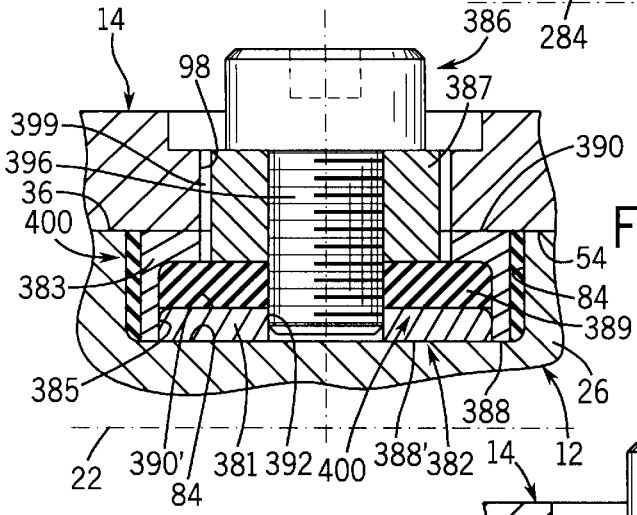
FIG. 20 is an enlarged view of another form of insert forming part of the attachment assembly of the present invention.
Figure 21:
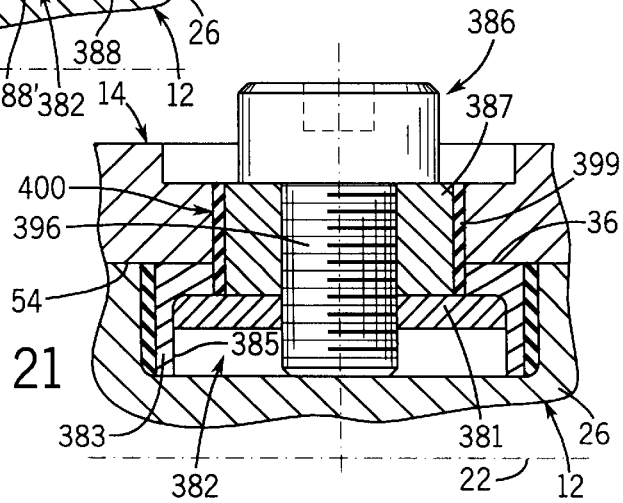
FIG. 21 is a view similar to FIG. 20 but showing the insert arranged in clamping relation relative to an interior surface of a blind cavity defined by the tool or replaceable part.

FIGS. 20 and 21 illustrate still another form for the insert of the hammerless attachment assembly of the present invention. This alternative form of insert is designated generally by reference numeral 382. The elements of this alternative hammerless attachment assembly that are functionally analogous to those components discussed above regarding attachment assembly 80 are designated by reference numerals identical to those listed above with the exception this embodiment uses reference numerals in the 300 series.

In the form illustrated in FIG. 20, the insert 382 comprises two metal pieces or parts 381 and 383. Piece 381 of insert 382 defines the internally threaded bore or opening 392 for the insert 382. The exterior configuration of piece 382 is sized to fit within the recess or cavity 84 on the side of the adapter 12. Moreover, piece 383 of insert 382 preferably defines inner and outer surfaces 388 and 390, respectively, which extend generally parallel relative to each other. In the embodiment illustrated, piece 381 also defines inner and outer surfaces 388' and 390', respectively. The inner and outer surfaces 388' and 390' of piece 381 are separated by a lesser distance than are corresponding surfaces on piece 383. Accordingly, when pieces 381 and 383 of insert 382 are initially assembly within the insert accommodating recess 84, an opening, gap or void 389 is provided between the parts 381 and 383.

As shown, the pieces 381 and 383 of insert 382 are configured such that piece 381 is prevented from separating from piece 383 as piece 381 is drawn toward the outer surface 390 of the insert 382 in response to rotation of the threaded fastener 386 to, ultimately, clamp the insert 382 against the interior surface of cavity 54 of the tool 14, as shown in FIG. 21, whereby releasably maintaining the adapter 12 and tool 14 in operable combination relative to each other. In this embodiment, piece 383 of insert 382 defines a generally centralized counterbore or seat 385 which is sized to accommodate piece 381 of the insert 382 therewithin.

In the embodiment illustrated in FIGS. 20 and 21, the fastener 386 of the hammerless attachment further includes a sleeve 387 which fits about and along the second or threaded portion 396 of fastener 386. As shown, the outside diameter of the sleeve 387 is slightly less than the inside diameter of the bore or hole 98 in the replaceable part 14 through which the second portion 396 of the fastener 386 extends thereby allowing the fastener 386 and insert 382 to form the threaded juncture therebetween. The size difference between the sleeve 387 and the opening 92 defines a gap, opening or void 399 therebetween.

As shown in FIGS. 20 and 21, elastomeric material 400 is provided, at least, in the opening, gap or void 389 provided between the parts 381, 383. Preferably, additional elastomeric material 400 is also be arranged between the sides of the insert 382 and the cavity or recess 84 in the adapter 12.

As will be appreciated, in response to rotation of the fastener 386, piece 381 is drawn toward the interior surface of the tooth pocket or cavity 54. As piece 381 is drawn toward the interior surface of the tooth pocket or cavity 54, the elastomeric material 400 is squeezed and flows from between the parts 381, 383 and preferably into the opening 399 around the annular sleeve 397 of fastener 386 and the closed margin of the aperture, bore or hole 398 in the replaceable tool 14. Likewise, the squeezed elastomeric material 400 tends to flow and fill a tolerance variations or voids separating that area on the adapter angled side 34 immediately surrounding the recess 84 and the confronting interior surface of the tooth pocket or cavity 54. As such, contaminants including small rocks, stones, dirt, dirt fines, dust, and moisture are inhibited from passing between the confronting surfaces of parts 12 and 14 and reaching the threaded juncture 397 between parts 382 and 386. Ultimately, rotation of the fastener 386 causes the multiple part insert 382 to be tightly clamped against the interior surface of the tooth cavity or pocket 54 while at least a portion of the insert 382 remains within the recess or cavity 84 thereby maintaining the adapter 12 and tooth 14 in operable combination relative to each other.

Figure 22:
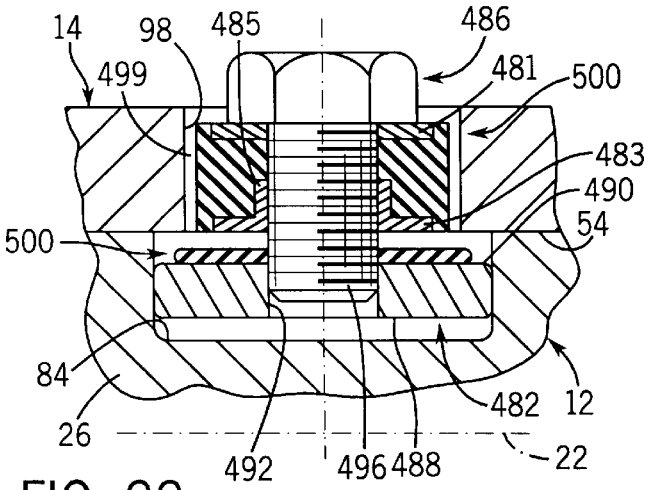
FIG. 22 is an enlarged view of still another form of insert forming part of the attachment assembly of the present invention.
Figure 23:
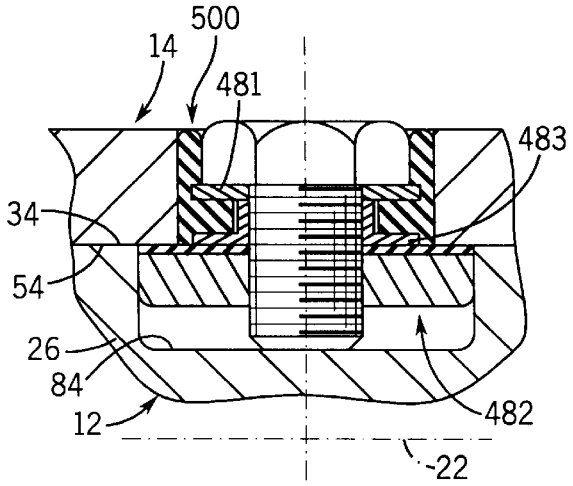
FIG. 23 is a view similar to FIG. 22 but showing the insert arranged in clamping relation relative to an interior surface of a blind cavity defined by the tool or replaceable part.

FIGS. 22 and 23 illustrate yet another form for the insert of the hammerless attachment assembly of the present invention. This alternative form of insert is designated generally by reference numeral 482. The elements of this alternative hammerless attachment assembly that are functionally analogous to those components discussed above regarding attachment assembly 80 are designated by reference numerals identical to those listed above with the exception this embodiment uses reference numerals in the 400 series.

In the form illustrated in FIGS. 22 and 23, the insert 482 and is sized to fit within the recess or cavity 84 on the side of the adapter 12 and defines a generally centrally disposed, internally threaded bore or opening 492. Insert 492 includes inner and outer surfaces 488 and 490, respectively, which preferably extend generally parallel relative to each other.

As shown in FIGS. 20 and 21, elastomeric material 500 is provided, at least, within the opening 98 in the tooth 14 in surrounding relation to and with a lengthwise portion of the fastener threaded shank portion 496 and the closed margin of the tooth aperture or hole 98. Preferably, additional elastomeric material 500 is arranged between the outer side or surface 490 of the insert 482 and the interior surface of the tooth cavity or pocket 54 against which the insert 482 is, ultimately, to be clamped.

In this embodiment, a metal washer or piece 481 is preferably disposed between the first or head portion 494 of the fastener 486 in surrounding relation to the second or shank portion 496 and in overlying relation to the elastomeric material 500. Moreover, another metal member or piece 483 is disposed in surrounding relation with the second or shank portion 496 of the fastener 486 beneath the metal washer 481. Preferably, member 483 includes an annular upstruck part 485 sized to extend about the shank portion 496 of the fastener 486 and designed to limit the amount the fastener 486 can be rotated in the first direction.

As will be appreciated, in response to rotation of the fastener 486, pieces 481 and 483 are drawn toward each other while concurrently moving the insert 482 toward the interior surface of the tooth pocket or cavity 54 and away from the adapter centerline 22. As pieces 481 and 483 move toward each other, in response to rotation of the fastener 486, the elastomeric material 500 is squeezed and flows from between the parts 481, 483 to preferably fill the opening 499 around a the second portion 496 of fastener 486 and the closed margin of the tool aperture 498.

Likewise, the squeezed elastomeric material 500 along the outer surface 490 of the insert 482 tends to flow and fill tolerance variations or voids separating that area on the adapter angled side 34 immediately surrounding the recess 84 and the confronting interior surface of the tooth pocket or cavity 54. As such, contaminants including small rocks, stones, dirt, dirt fines, dust, and moisture are inhibited from reaching and adversely effecting the threaded juncture 497 between parts 482 and 486 of assembly 480. Ultimately, rotation of the fastener 486 causes the insert 482 to be drawn into a clamping relationship with the interior surface of the tooth cavity or pocket 54 while at least a portion of the insert 482 remains within the recess or cavity 84 thereby maintaining the adapter 12 and tooth 14 in operable combination relative to each other.

Figure 24:
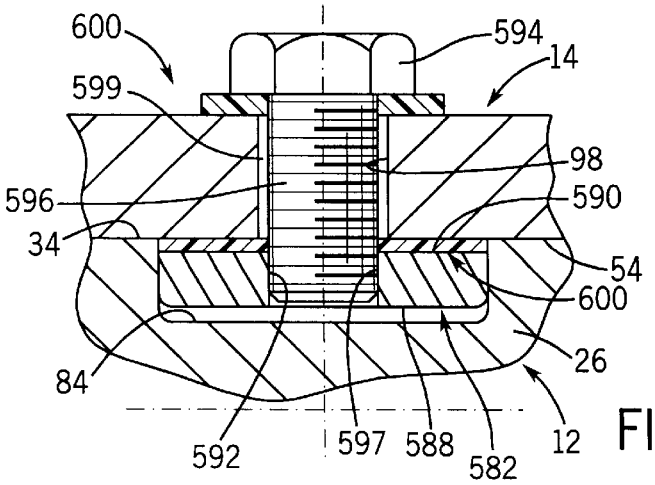
FIG. 24 is an enlarged, partially sectioned, view of yet another form of insert forming part of the attachment assembly of the present invention.

FIG. 24 illustrates still another form of the present invention. In this alternative embodiment, the insert is designated generally by reference numeral 582. The elements of this alternative hammerless attachment assembly that are functionally analogous to the components discussed above regarding attachment assembly 80 are designated by reference numerals identical to those listed above except this embodiment uses reference numerals in the 500 series.

In the embodiment illustrated in FIG. 24, the insert 582 defines a generally centrally disposed, internally threaded bore or opening 592 and is sized to fit within the recess or cavity 84 on the side of the adapter 12. Insert 592 includes inner and outer surfaces 588 and 590 which, in the exemplary embodiment, extend generally parallel relative to each other.

As shown in FIG. 24, elastomeric material 600 is provided, at least, beneath the first or head portion 594 and in surrounding relation to and with a lengthwise portion or section of the threaded shank portion 596 of the fastener 586. Notably, in the exemplary embodiment, the elastomeric material 600 extends beyond the periphery of the closed margin of the aperture or hole 98 in the tooth 14 through which the threaded shank portion 596 of fastener 586 extends. Preferably, additional elastomeric material 600 is arranged between the outer side or surface 590 of the insert 582 and the interior surface of the tooth cavity or pocket 54 against which the insert 582 is, ultimately, to be disposed in clamping relationship therewith.

As will be appreciated, in response to rotation of the fastener 586, the insert 582 is drawn toward the interior surface of the tooth pocket or cavity 54. As such, and as the insert 582 begins to tighten its clamped relation with an interior surface of the blind cavity 54, the elastomeric material 600 is squeezed between the head portion 594 and the exterior side of the tooth 14 such that contaminants including small rocks, stones, dirt, dirt fines, dust, and moisture are inhibited from passing into opening 599 and along the second or shank portion 596 of the fastener 586. Accordingly, the elastomeric material 600 inhibits such contaminants from reaching and adversely effecting the threaded juncture 597 between the parts 582 and 586 of assembly 580.

Likewise, the pressed or squeezed elastomeric material 600 along the outer surface 590 of the insert 582 tends to flow and fill tolerance variations or voids separating that area on the adapter angled side 34 immediately surrounding the recess 84 and the confronting interior surface of the tooth pocket or cavity 54. As such, contaminants including small rocks, stones, dirt, dirt fines, dust, and moisture are inhibited from passing between the conjoined surfaces of the adapter 12 and replacement part 14 and reaching and adversely effecting the threaded juncture 597 between parts 582 and 586 of assembly 580. Ultimately, rotation of the fastener 586 causes the insert 582 to be drawn into a tight clamping relationship with the interior surface of the tooth cavity or pocket 54 while at least a portion of the insert 582 remains within the recess or cavity 84 thereby maintaining the adapter 12 and tooth 14 in operable combination relative to each other.

Another feature of the present invention involves configuring the attachment assembly 80 of the present invention to facilitate self-centering of the replacement part 14 on the adapter nose portion 26. To effect such ends, the insert 82 and the insert accommodating recess or cavity 84 on the side surface of the adapter 12 define complimentary surfaces which cooperate relative to each other to stabilize the tool 14 on the adapter nose portion 26.

In one form illustrated in FIG. 25, a rear edge or surface 102 of the insert 82 is configured with an arc or curve 104 having a first predetermined radius. Similarly, the rear end or surface of the cavity or recess 84 in the side of the adapter nose portion 26 is configured with an arc or curvature 114 having a second predetermined radius. The first and second predetermined radiuses defined by the curves 104 and 114 either correspond relative to each other or the second predetermined radius 114 is slightly greater than the first radius 104. As such, and as the replacement part 14 guided by the fastener 86 moves rearwardly onto the adapter nose portion 26, the complimentary surfaces 104 and 114 serve to urge the part 14 toward a self-centered relationship relative to the adapter nose portion 26.

In the form illustrated in FIG. 26, a rear edge or surface 102 of the insert 82 is configured with angled camming surfaces or sides 124, 126 which converge toward a rear end and toward a longitudinal centerline 83 of the insert 82. Similarly, the rear end or surface of the cavity or recess 84 in the side of the adapter nose portion 26 is configured with angled camming surfaces or sides 134, 136 which converge toward a rear end and toward a longitudinal centerline 87 of the recess or cavity 84. The confronting camming surfaces 124, 134 and 126, 136 either correspond relative to each other or are disposed relative to each other to advantageously locate insert 82 within the cavity or recess 84. As such, and as the replacement part 14 guided by the fastener 86 moves rearwardly onto the adapter nose portion 26, the complimentary surfaces 124, 134 and 126, 136 serve to urge replacement part 14 toward a self-centered relationship relative to the adapter nose portion 26.

Still another salient feature of the present invention relates to configuring the hammerlesss attachment assembly 80 of the present invention to enhance the conjuncture between the adapter 12 and the replaceable part 14 in response to rotation of the fastener 86 in a direction to affix the replaceable part 14 in operable combination with the adapter 12. More specifically, and in a preferred embodiment, the hammerless attachment assembly 80 is designed such that the replacement part or tool 14 is urged onto the adapter nose portion 26, thereby enhancing the conjuncture between parts 12 and 14 of the two-part digging system 10, in response to rotation of the fastener 86 in a direction to tighten the clamping relationship between the insert 82 and the interior surface of the tooth blind cavity or pocket 54.

As illustrated in FIG. 27, the insert 82 is preferably configured whereby the distance separating the inner and outer surfaces 88 and 90, respectively, is less than the distance separating the bottom surface 85 of the recess or cavity 84 from the exterior side or surface on the adapter nose portion 26 defining such recess or cavity 84. As such, and after the replacement part 14 is initially fitted about the adapter nose portion 26, an opening or space 81 separates the insert's outer surface 90 from the interior surface of the tool's blind cavity and against which the insert 82 is to be clamped in response to rotation of the fastener 86 so as to maintain the adapter 12 and part 14 in operable combination relative to each other.

In accordance with this aspect of the invention, the insert 82 and cavity or recess 84 in the adapter nose portion 26 define cooperative surfaces 140 and 150, respectively, therebetween. In a preferred embodiment, surface 140 on the insert 82 is arranged in confronting relation with surface 150 on the insert accommodating recess 84. Preferably, surfaces 140, 150 are arranged in abutting and generally parallel relation relative to each other. In one form, the confronting surfaces 140, 150 each extend at an acute angle ranging between about 30° and about 50° relative to the longitudinal axis 22 of the adapter nose portion 26. In a most preferred embodiment, the confronting surfaces 140, 150 each extend at an acute angle of about 45° relative to the longitudinal axis 22 relative to the adapter nose portion 126.

As shown, and as discussed above, at least a lengthwise portion of the fastener 86 extends endwise through the closed marginal bore, opening, aperture, or hole 98 in the side of part 14. As shown in FIG. 28, and in response to rotation of the fastener 86 in a first direction about axis 93, the insert 82 is drawn toward the interior surface of the tooth cavity or pocket 54. As such, the space 81 between the outer surface 90 of the insert 82 and the interior surface of the tooth cavity or pocket 54 reduces while concurrently therewith surface 140 on the insert 82 is guided along confronting surface 150 on the adapter nose portion 26. As surface 140 on the insert 82 is guided and moves along confronting surface 150 on the adapter nose portion 26 in response to tightening of the fastener 86, the insert 82 forcibly moves or drives the fastener 86 in the direction of the arrow 160 in FIG. 28. With at least a lengthwise portion of the fastener 86 being entrapped within the tool's closed marginal bore 98, the forced movement of the fastener 86 effects corresponding endwise movement of the tool 14 in the direction of the arrow 160 thereby forcing tool 14 onto the adapter nose portion 26, thus, enhancing the conjuncture therebetween.

In that embodiment illustrated in FIGS. 27 and 28, an exterior side or surface of the replacement part or tool 14 is preferably configured or contoured with a raised area 164 in advance of the fastener head portion 94. As such, a major portion or section of the fastener head portion 94 is protected against ground engaging abrasives acting to wear down or reduce the first or head portion 94 of the fastener 86 during operation of the two-part digging system 10.

With the attachment assembly of the present invention, the heretofore known problems associated with elongated pinning systems is eliminated. More specifically, the attachment assembly of the present invention is essentially hammerless in operation. That is, the present invention eliminates requiring an operator to forcibly pound and, thus, move an elongated retaining element to effect repair/replacement of part 14 of the two-part digging system. With the present invention, repair and/or replacement of the tool 14 is quickly and easily facilitated in an optimum manner simply by rotating the fastener 86 about axis 93 to release the connection between parts 82 and 86 of the attachment assembly 80 thereby readily allowing for repair/replacement of part 14. After part 14 has been repaired/replaced, fastener 86 is reinserted through hole 98 in part 14 and into threaded engagement with insert 82 to again releasably secure adapter 12 and part 14 in operable combination with each other.

Moreover, the design of the attachment assembly of the present invention is inherently stronger than other heretofore known replaceable part systems. That is, the attachment assembly 80 requires only a recess 84 to be provided on the exterior side of the adapter nose portion 26 rather than an elongated bore extending completely therethrough. As will be appreciated, the recess or cavity 84 adds significantly to the overall strength of the adapter nose portion by eliminating a throughbore extending from one side of the adapter nose portion to the other. Using a recess or cavity rather than bore which opens at opposite ends thereof furthermore eliminates inherent "run out" problems associated with such bores.

With the present invention, the threaded juncture 87 between parts 82 and 86 of assembly 80 is designed to facilitate release of the attachment assembly notwithstanding exposure of the two-part digging system to environmental conditions which would normally cause corrosion, oxidation, rusting and deterioration of the operative junction between the parts. In one form of the invention, the insert 82 of the attachment assembly 80 is fabricated from a corrosion resistant non-ferrous metal, thus, concerns over corrosion of the threaded juncture between the component parts 82 and 86 is eliminated.

Alternatively, elastomeric material is arranged in operable combination with the insert 82 and the rotatable fastener 86 to inhibit contaminants from adversely effecting the threaded juncture 87 between such parts of the hammerless attachment assembly. In another form of the invention, the elastomeric material extends along at least the entire lengthwise section of the externally threaded shank portion 96 of the fastener 86 extending through the insert 82. The elastomeric material can be configured as part of the insert and can define the internally threaded bore 92 while having an exterior configuration to inhibit separation of the elastomeric material from insert 82 as said insert 82 is drawn toward and, ultimately, clamped against an interior side surface of the blind cavity or pocket 54 defined by the replaceable tool 14.

Suffice it to say, the elastomeric material arranged in combination with the components parts 82 and 86 of the attachment assembly 80 limits adverse effects of contaminants on the threaded juncture 87 whereby facilitating rotation of the fastener 86 in a direction to effect release of the replaceable part 14 from operable combination with the adapter 12. Additionally, and in that embodiment of the invention wherein the elastomeric material is arranged in surrounding relation relative to the insert 82, the elastomeric material will naturally tend to offer shock and impact resistence to the connection which releasably maintains the adapter and part 14 in operable combination relative to each other.

The design of the attachment system 80 according to the present invention is particularly beneficial when arranged in combination with a two-part digging system wherein the juncture between the nose portion 26 of the adapter 12 and the replaceable part 14 has a rhombus-like cross-section. According to still another aspect of the invention, and although arranged or offset to one side thereof, the attachment assembly 80 is configured to facilitate stabilization between the nose portion 26 of the adapter 12 an the tool 14. In a preferred embodiment, the insert 82 and the recess or pocket 84 defined on the side surface of the adapter 12 define complimentary surfaces which cooperate relative to each other to center the tool 14 on the nose portion of the adapter 12 thereby advantageously effecting the connection therebetween.

Yet another advantageous feature of the present invention relates to the ability of the attachment assembly 80 to enhance the conjuncture between the adapter 12 and tool 14 by urging the tool 14 onto the nose portion 26 of the adapter 12 in response to the fastener 86 being rotated in a direction to tighten the clamping relationship of the insert 82 against the interior surface of the blind cavity 54 defined by the tool 14. To effect such ends, the rotatable fastener 86 of the attachment assembly 80 includes a lengthwise portion for engaging a closed margin of the opening or aperture 98 in the side of the replacement part 14 through which the fastener 86 extends. Moreover, the insert 82 and the insert accommodating recess 84 on the nose portion 26 of the adapter 12 define surfaces 140 and 150, respectively, which cooperate relative to each other as the insert 82 is drawn toward the interior surface of the cavity, in response to rotation of the fastener 86. The surfaces 140, 150 cause the insert 82 and, ultimately, the replacement part 14 to move rearward in a direction extending generally parallel to the longitudinal axis 22 of the adapter 12 thereby enhancing the tightness of the conjuncture between the interior surfaces of the blind cavity 54 and the adapter nose portion 26.

From the foregoing it will be observed numerous modifications and variations can be effected without departing or detracting from the true spirit and novel scope of the present invention. It will be appreciated, the present disclosure is intended to set forth exemplifications of the invention which are not intended to limit the invention to the specific embodiments illustrated. The disclosure is intended to cover by the appended claims all such modifications and variations as fall within the spirit and scope of the claims.

What is claimed is:

1. A hammerless attachment assembly for releasably maintaining a ground engaging tool and an adapter in operable combination relative to each other, with said ground engaging tool defining an open ended blind cavity between multiple sides, said hammerless attachment assembly comprising:

an insert nonrotatably fitted within a recess defined on a side of a nose portion of said adapter, said insert defining an internally threaded bore;

a rotatable fastener having a head portion and an externally threaded shank portion, said shank portion of said fastener being sized to extend lengthwise through an opening having a closed margin defined in a side of said tool, with the opening in the side of said tool generally aligning with the internally threaded bore in said insert when said tool is positioned on the nose portion of the adapter, and with the externally threaded shank portion of said fastener forming a threaded juncture with the internally threaded bore on the insert such that, in response to rotation of said fastener in a first direction, said insert is drawn toward and ultimately moved into clamping relation with an interior side surface of said blind cavity while remaining, at least partially, within said recess, thereby releasably maintaining said tool and adapter in operable combination relative to each other; and wherein elastomeric material is disposed in operable combination with said rotatable fastener and said insert for inhibiting contaminants from adversely effecting said threaded juncture whereby facilitating rotation of said fastener in a direction opposed to said first direction when said tool is to be released from operable combination with said adapter.

2. The hammerless attachment assembly according to claim 1 wherein said insert and the recess defined on the side surface of the adapter define complimentary surfaces which cooperate relative to each other to stabilize the tool on the nose portion of the adapter.

3. The hammerless attachment assembly according to claim 1 wherein said elastomeric material is configured as part of said insert and defines the internally threaded bore thereof, with said elastomeric material having an exterior configuration which inhibits separation of said elastomeric material from insert as said insert is drawn toward and ultimately moved into clamping relation with an interior side surface of said blind cavity defined by said tool.

4. The hammerless attachment assembly according to claim 3 wherein said elastomeric material extends along at least the entire lengthwise section of said externally threaded shank portion of the fastener extending through said insert.

5. The hammerless attachment assembly according to claim 1 wherein said insert includes inner and outer surfaces, with said inner surface of said insert being arranged in confronting relation relative to said adapter and with said outer surface of said insert being arranged adjacent an interior side surface of the blind cavity defined by said tool after said fastener is rotated to draw said insert into clamping relationship with the interior side surface of the blind cavity defined by said tool.

6. The hammerless attachment assembly according to claim 5 wherein said elastomeric material is disposed between an outer surface of said insert and said interior side of said blind cavity and extends into operable surrounding relation with said externally threaded shank portion of said fastener thereby inhibiting contaminants from getting through to said threaded juncture between said fastener and said insert.

7. The hammerless attachment assembly according to claim 6 wherein said elastomeric material has a Shore A hardness ranging between about 50 and about 80.

8. The hammerless attachment assembly according to claim 1 wherein said insert comprises a first part defining said internally threaded bore and a second part arranged in operable engagement with said first part.

9. A hammerless attachment assembly for releasably maintaining a ground engaging tool and an adapter in operable combination relative to each other, with said ground engaging tool defining an open ended blind cavity between multiple side surfaces, said hammerless attachment assembly comprising:

an insert nonrotatably fitted within a recess defined on a side surface of a nose portion of said adapter, said insert defining an internally threaded bore;

a rotatable fastener having a head portion and an externally threaded shank portion, said shank portion of said fastener being sized to extend lengthwise through an opening having a closed margin defined in a side of said tool, with the opening in the side wall of said tool generally aligning with the internally threaded bore in said insert when said tool is positioned onto the nose portion of the adapter, and with the externally threaded shank portion of said fastener forming a threaded juncture with the internally threaded bore on the insert such that, in response to rotation of said fastener in a first direction, said insert is drawn toward and ultimately moved into a clamping relationship relative to an interior side surface of said blind cavity while remaining, at least partially, within said recess thereby releasably maintaining said tool and adapter in operable combination relative to each other; and wherein said insert is formed from a corrosion resistant nonferrous material whereby facilitating rotation of said fastener in a direction opposed to said first direction when said tool is to be released from operable combination with said adapter.

10. A hammerless attachment assembly for releasably maintaining a two-part digging tooth assembly including a ground engaging tooth and an adapter in operable combination relative to each other, said adapter including a free ended nose portion having a longitudinal axis and including multiple exterior surfaces, and with said ground engaging tool defining an open ended blind cavity between multiple side surfaces for allowing said tooth to fit about and lengthwise along said nose portion of the adapter, said hammerless attachment assembly comprising:

a first part nonrotatably fitted within a recess defined on one of said exterior surfaces of said nose portion of said adapter;

a rotatable second part operably associated with said first part, with a lengthwise portion of said second part extending through an opening in one of said sides of the tooth and forming an operative juncture with said first part, and wherein, in response to rotation of said second part in a first direction said tooth and said adapter are releasably clamped to each other as through the attachment assembly thereby releasably maintaining said tooth and adapter in operable combination relative to each other; and wherein elastomeric material is disposed in operable combination with said first and second parts for inhibiting contaminants from getting through to said operative juncture whereby facilitating rotation of said second part in a direction opposed to said first direction when said tooth is to be released from operable combination with said adapter.

11. The hammerless attachment assembly according to claim 10 wherein said first part is an insert having an internally threaded bore, and wherein said second part is a threaded fastener which combines with said insert to releasably maintain said adapter and said tooth in operable combination relative to each other.

12. The hammerless attachment assembly according to claim 11 wherein said insert and the recess defined on the side surface of the adapter define complimentary surfaces which cooperate relative to each other to stabilize the tooth on the nose portion of the adapter.

13. The hammerless attachment assembly according to claim 11 wherein said elastomeric material is disposed between said insert and a confronting interior side of said blind cavity and extends into operable surrounding relation with an externally threaded shank portion of said fastener thereby inhibiting contaminants from getting through to said operative juncture between said first and second parts of said attachment assembly.

14. The hammerless attachment assembly according to claim 10 wherein said elastomeric material has a Shore A hardness ranging between about 50 and about 80.

15. The hammerless attachment assembly according to claim 10 wherein said first part is a metal insert having inner and outer sides disposed at different distances from the longitudinal centerline of the nose portion of said adapter, with the inner side of said insert being arranged in closer proximity to the longitudinal centerline of the nose portion of said adapter than is said outer side of said insert, and wherein said insert and said adapter include cooperating angularly ramped surfaces which enhance the conjuncture between said tooth and adapter in response to the outer surface of said insert being drawn toward and into clamping relationship with the interior surface of said blind cavity.

16. A hammerless attachment assembly for a two-part digging tooth system including an adapter having an elongated nose portion about which a digging tooth is lengthwise fitted in relatively snug relationship therewith, said adapter having top and bottom surfaces, with the top surface of the nose portion of said adapter having two angled sides disposed on opposite lateral sides of a longitudinal centerline of said nose portion of said adapter, with said tooth defining a blind cavity open to a rear end of the tooth and formed by sides of the tooth, and wherein a cross section of said cavity is complimentary in shape to a corresponding cross section of the nose portion of said adapter, with said hammerless attachment assembly comprising:

an insert nonrotatably fitted within an open top recess disposed toward a rear of said nose portion and is generally centered on an angled side of the top surface of the nose portion of said adapter, with said insert defining an internally threaded bore, and wherein said recess defines an axis extending generally normal to the side surface to which said recess opens;

a rotatable fastener having a head portion and an externally threaded shank portion, said shank portion of said fastener being sized to extend lengthwise through an opening having a closed margin defined in a side of said digging tooth, with the opening in the side of said digging tooth generally aligning with the internally threaded bore in said insert when said tooth is positioned on the nose portion of the adapter, and with the externally threaded shank portion of said fastener forming a threaded juncture with the internally threaded bore on the insert such that, in response to rotation of said fastener in a first direction, said insert is drawn toward and ultimately moved into clamping relation with an interior side surface of said blind cavity while remaining, at least partially, within said recess, thereby releasably maintaining said tool and adapter in operable combination relative to each other; and wherein elastomeric material is disposed in operable combination with said rotatable fastener and said insert for limiting adverse effects of contaminants on said threaded juncture whereby facilitating rotation of said fastener in a direction opposed to said first direction when said tool is to be released from operable combination with said adapter.

17. The hammerless attachment assembly according to claim 16 wherein said insert and the recess defined on the side surface of the adapter define complimentary surfaces which cooperate relative to each other to stabilize the tooth on the nose portion of the adapter.

18. The hammerless attachment assembly according to claim 16 wherein said elastomeric material is configured as part of said insert and defines the internally threaded bore thereof, with said elastomeric material having an exterior configuration which inhibits separation of said elastomeric material from insert as said insert is drawn toward and ultimately moved into clamping relation with an interior side surface of said blind cavity defined by said tooth.

19. The hammerless attachment assembly according to claim 18 wherein said elastomeric material extends along at least the entire lengthwise section of said externally threaded shank portion of the fastener extending through said insert.

20. The hammerless attachment assembly according to claim 18 wherein said insert includes inner and outer surfaces, with said inner surface of said insert being arranged in confronting relation relative to said adapter and with said outer surface of said insert being arranged adjacent an interior side surface of the blind cavity defined by said tooth after said fastener is rotated to draw said insert into clamping relationship with the interior side surface of the blind cavity defined by said tooth.

21. The hammerless attachment assembly according to claim 20 wherein said elastomeric material is disposed between an outer surface of said insert and said interior side of said blind cavity and extends into operable surrounding relation with said externally threaded shank portion of said fastener thereby inhibiting contaminants from getting through to said threaded juncture between said fastener and said insert.

22. The hammerless attachment assembly according to claim 16 wherein said insert comprises a first part defining said internally threaded bore and as second part arranged in operable engagement with said first part.

23. A hammerless attachment assembly for releasably maintaining a ground engaging tooth and an adapter in operable combination relative to each other, said adapter including a free ended nose portion having a longitudinal axis and including multiple exterior surfaces, and with said ground engaging tooth defining an open ended blind cavity between multiple sides for allowing said tooth to fit about and lengthwise along said nose portion of said adapter, said hammerless attachment assembly comprising:

an insert nonrotatably fitted within a recess defined on an exterior surface of the nose portion of said adapter, said insert defining an internally threaded bore;

a rotatable fastener having a head portion and an externally threaded shank portion, with said shank portion being sized to extend lengthwise through an opening in one of said sides of the tooth and threadably engage with the internally threaded bore of said recess while having a portion of said fastener engaging a closed margin of said opening defined by one of said sides of said tooth, and such that, in response to rotation of said fastener in a first direction, said insert is drawn away from the longitudinal axis of said nose portion of the adapter and ultimately moved into clamping relation with an interior side surface of said blind cavity while remaining, at least partially, within said recess, thereby releasably maintaining said tooth and adapter in operable combination relative to each other; and wherein said insert and the recess in the nose portion of said adapter define confronting surfaces which cooperate relative to each other as said insert is drawn away from the longitudinal centerline of said adapter to axially move said tooth toward a rear end of the nose portion of said adapter thereby enhancing a conjuncture between the cavity in said tooth and the exterior surfaces on the nose portion of the adapter.

24. The hammerless attachment assembly according to claim 23 wherein the confronting surfaces defined on said adapter and said insert are arranged in generally parallel relation relative to each other.

25. The hammerless attachment assembly according to claim 23 wherein the confronting surfaces defined on said adapter and said insert each extend at an acute angle ranging between about 30° and about 50° relative to the longitudinal axis of the nose portion of said adapter.

26. The hammerless attachment assembly according to claim 23 wherein the confronting surfaces defined on said adapter and said insert each extend at an acute angle of about 45° relative to the longitudinal axis of the nose portion of said adapter.

* * * * *